US009769894B2

(12) United States Patent
Chowdhury et al.

(10) Patent No.: US 9,769,894 B2
(45) Date of Patent: Sep. 19, 2017

(54) CONTROLLING LED CURRENT FROM A CONSTANT VOLTAGE SOURCE

(71) Applicant: ABL IP Holding LLC, Decatur, GA (US)

(72) Inventors: Towfiq Chowdhury, Des Plaines, IL (US); Feng Chen, Hoffman Estates, IL (US)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 14/317,621

(22) Filed: Jun. 27, 2014

(65) Prior Publication Data

US 2015/0382421 A1 Dec. 31, 2015

(51) Int. Cl.
*H05B 33/08* (2006.01)

(52) U.S. Cl.
CPC ..... *H05B 33/0845* (2013.01); *H05B 33/0815* (2013.01)

(58) Field of Classification Search
USPC ..... 315/291, 297, 299, 300, 307, 308, 311, 315/DIG. 4
See application file for complete search history.

(56) References Cited

U.S. PATENT DOCUMENTS 8,111,017 B2 * 2/2012 Lin ..... H05B 33/0845 315/209 R
8,319,445 B2 11/2012 McKinney et al.
8,497,637 B2 7/2013 Liu
8,558,482 B2 10/2013 Chu

OTHER PUBLICATIONS

TOP242-250, TOPSwitch-GX Family Extended Power, Design Flexible, EcoSmart, Integrated Off-line Switcher, Power Integrations, Sep. 2003.
TPS92510, 1.5-A Constant-Current Buck Converter for High-Brightness LEDs with Integrated LED Thermal Foldback, Texas Instruments, SLUSAE4A—Jan. 2012—Revised Aug. 2012.
UCC28700, UCC28701 UCC28702, UCC28703, Constant-Voltage, Constant-Current Controller With Primary-Side Regulation, Texas Instruments, SLUSB41—Jul. 2012.
LM3401 Hysteretic PFET Controller for High Power LED Drive, Texas Instruments, SNVS516C—Aug. 2007—Revised May 2013.

* cited by examiner

*Primary Examiner* — Douglas W Owens
*Assistant Examiner* — Jianzi Chen
(74) *Attorney, Agent, or Firm* — Kilpatrick Townsend & Stockton, LLP

(57) ABSTRACT

An LED driver circuit provides dimming control in LED lighting applications that can accommodate an AC/DC constant voltage converter. The driver circuit provides a dimming control signal that is used to directly control the DC output current of a downstream DC/DC converter driving an LED array. The dimming control signal tracks the AC or DC output from a dimming controller such that variations in the AC or DC voltage are reflected in the dimming control signal. This dimming control signal is then provided to the downstream DC/DC converter, bypassing the AC/DC constant voltage converter to directly control dimming of the LED array. Such an arrangement lets lighting design engineers deploy the familiar and well-understood constant voltage converter topology in LED lighting applications while retaining the ability to control dimming in the LED lighting applications.

23 Claims, 17 Drawing Sheets

CONTROLLING LED CURRENT FROM A CONSTANT VOLTAGE SOURCE

FIELD OF THE INVENTION

The disclosed embodiments relate generally to methods and systems for controlling current from a constant voltage source to drive solid-state lighting devices, such as light emitting diodes (LEDs), and more particularly to a method and system for controlling such current in order to provide a dimming function for the LEDs.

BACKGROUND OF THE INVENTION

LEDs have the potential to revolutionize the efficiency, appearance, and quality of lighting. See http://www.energystar.gov/index.cfm?c=lighting.pr_what_are. The United States Department of Energy estimates that rapid adoption of LED lighting in the U.S. could provide savings of roughly $265 billion, avoid 40 new power plants, and reduce lighting electricity demand by 33% by 2027. Thus, the market for LED lighting is expected to grow significantly in the coming years compared to traditional, non-LED based lighting.

An LED emits light when a voltage exceeding a certain minimum is applied across the LED to enable current to flow through the LED. The current flowing through the LED, or forward current, must be a direct current (DC) and therefore LEDs require a DC source to drive the LEDs. Additionally, due to the particular voltage-current characteristic of an LED, small changes in the voltage applied can result in large changes in the current flowing through the LED, and hence the amount of light emitted by the LED. The disproportionate voltage-current response can make it difficult to implement functions that rely on precise current control in LED lighting applications, such as dimming.

Most LED lighting applications employ an LED driver to drive an array or multiple arrays of LEDs. The LED driver typically includes a power converter that converts the line AC into the DC source needed to drive the LED arrays. There are generally two types of power converters: AC/DC constant voltage converters, and AC/DC constant current converters. An AC/DC constant current converter, as the name suggests, takes an AC input voltage and provides a relatively constant DC output current, while an AC/DC constant voltage converter takes the AC input voltage and provides a relatively constant DC output voltage.

Because small voltage variations across an LED can produce large changes in the LED forward current, LED drivers that use an AC/DC constant voltage converter must usually include a downstream current-limiting resistor or current-regulating circuit in order to maintain the desired LED forward current. An AC/DC constant current converter, on the other hand, can ordinarily control the forward current much more precisely despite small voltage variations. As a result, AC/DC constant current converters are generally more suitable than AC/DC constant voltage converters for implementing dimming in LED lighting applications.

AC/DC constant voltage converters, however, are more commonly used and better understood than AC/DC constant current converters. This is due in part to the generally accommodating design of the AC/DC constant voltage converter topology, the lower cost resulting from wide popularity of the design, and well-established supply chains for AC/DC constant voltage converter components. Thus, there is a general preference in the lighting industry to continue using AC/DC constant voltage converters for lighting applications, including LED lighting applications.

A drawback of using an AC/DC constant voltage converter in LED lighting applications is the LED driver cannot readily provide dimming. In a typical LED lighting application, the AC/DC constant voltage converter is connected to a downstream DC/DC converter that converts the constant DC output voltage to a corresponding DC output current to drive the LED array. The problem is the AC/DC constant voltage converter will try to maintain its DC output voltage constant even during dimming, when the AC output is being decreased by the dimming controller. This constant DC output voltage causes the DC/DC converter to keep its DC output current the same, so the LED arrays do not dim. In addition, the AC/DC constant voltage converter will try to draw more current from the dimming controller in order to offset the decrease in the AC output. This increased current may cause the current rating of the dimming controller to be exceeded in some cases, potentially damaging the dimming controller over time, and may also require the transformer of the AC/DC constant voltage converter to be over designed.

Thus, a need exists for an improved way to provide dimming in LED lighting applications, and particularly for a way to control dimming in LED lighting applications that can use AC/DC constant voltage converters.

SUMMARY OF THE DISCLOSED EMBODIMENTS

The disclosed embodiments are directed to a method and system for controlling dimming in LED lighting applications that can accommodate an AC/DC constant voltage converter. The method and system provide a dimming control signal that directly controls the DC output current of a downstream DC/DC converter to drive an LED array. The dimming control signal tracks the output from the dimming controller, which may be an AC output or a DC output, such that variations in that AC output are reflected in the dimming control signal. This dimming control signal is then provided to the downstream DC/DC converter, bypassing the AC/DC constant voltage converter, to directly control the dimming of the LED array. Such an arrangement lets lighting design engineers use familiar and well-understood constant voltage converter topologies in LED lighting applications while also being able to provide dimming control in the LED lighting applications.

In some embodiments, the dimming control signal may be provided by a dimming detection circuit operating separately from the AC/DC constant voltage converter. The dimming detection circuit may detect variations in the AC or DC output from the dimming controller and may generate a dimming control signal that corresponds to the variations. This dimming detection circuit may provide the dimming control signal directly to the downstream DC/DC converter to control the output current of the downstream DC/DC converter. Alternatively, an optical-coupler or other isolation device may be used in some implementations to isolate the dimming detection circuit from the downstream DC/DC converter.

In some embodiments, dimming detection circuit may be an RMS (root mean square) detection circuit configured to detect the RMS value of the AC output from the dimming controller in some embodiments. In these embodiments, the dimming control signal produced by the dimming detection circuit may take the form of a pulse-width-modulated (PWM) signal. The PWM signal may have a duty cycle or frequency that varies in proportion to the RMS value of the AC output from the dimming controller. The variation in the duty cycle or frequency of the dimming control signal may be set using a linear lookup table, a non-linear lookup table, a predefined equation, and the like, in relation to the AC output from the dimming controller.

In some embodiments, dimming detection circuit may be a DC detection circuit configured to detect the DC output from the dimming controller in some embodiments. The dimming control signal produced by the dimming detection circuit in these embodiments may also take the form of a PWM signal. The PWM signal may have a duty cycle or frequency that varies in proportion to voltage level of the DC output from the dimming controller. The variation in the duty cycle or frequency of the dimming control signal may be set using a linear lookup table, a non-linear lookup table, a predefined equation, and the like, in relation to the DC output from the dimming controller.

In addition to a dimming control signal, in some embodiments, the method and system disclosed herein may also allow the AC/DC constant voltage converter to self-govern the amount of current it draws during dimming. In these embodiments, the AC/DC constant voltage converter may limit the maximum amount of current drawn from the dimming controller based on the RMS value of the AC output from the dimming controller. This maximum current amount may be set, for example using a lookup table, a predefined equation, and the like.

Alternatively, in some embodiments, the dimming detection circuit may provide a current control signal to the AC/DC constant voltage converter to control the amount of current it consumes. Like the dimming control signal, the current control signal may track the AC or DC output from the dimming controller and may limit the maximum current drawn based on the AC or DC output. This maximum current may also be set using a linear lookup table, a non-linear lookup table, or a predefined equation, in relation to the AC or DC output from the dimming controller. As a result, the amount of current drawn by the AC/DC constant voltage converter is reduced when the AC or DC output from the dimming controller is reduced during dimming. Such an arrangement not only optimizes current consumption during dimming, but is particularly useful in lighting applications where dimming controller current or circuit breaker trip current may be limited.

In general, in one aspect, the disclosed embodiments are directed to a driver circuit for driving a light source. The driver circuit comprises an AC/DC constant voltage converter configured to receive a dimming control output from a dimming controller and provide a constant DC output voltage, and a DC/DC converter connected to the AC/DC constant voltage converter and configured to receive the constant DC output voltage from the AC/DC constant voltage converter, the DC/DC converter further configured to provide a DC output current to the light source. The driver circuit further comprises a dimming detection circuit connected to the AC/DC constant voltage converter, the dimming detection circuit configured to detect the dimming control output received by the AC/DC constant voltage converter and provide a dimming control signal to the DC/DC converter. The dimming control signal causes a change in the DC output current provided by the DC/DC converter to the light source when the dimming detection circuit detects a change in the dimming control output received by the AC/DC constant voltage converter.

In general, in another aspect, the disclosed embodiments are directed to a method of driving an LED light source using an AC/DC constant voltage converter and a DC/DC converter. The method comprises detecting a dimming control output at the AC/DC constant voltage converter from a dimming controller, and providing a dimming control signal to the DC/DC converter in response to detecting the dimming control output at the AC/DC constant voltage converter. The method further comprises detecting a change in the dimming control output at the AC/DC constant voltage converter, and changing the dimming control signal provided to the DC/DC converter in proportion to the change detected in the dimming control output at the AC/DC constant voltage converter. The dimming control signal causes a change in a DC output current provided by the DC/DC converter when a change is detected in the dimming control output at the AC/DC constant voltage converter, and the dimming detection circuit is coupled to the DC/DC converter using an isolation device.

In general, in still another aspect, the disclosed embodiments are directed to a driver circuit for driving LED light sources. The driver circuit comprises an AC/DC constant voltage converter configured to receive an dimming control output from a dimming controller and provide a constant DC output voltage, and a plurality of DC/DC converters connected to the AC/DC constant voltage converter, each DC/DC converter configured to receive the constant DC output voltage from the AC/DC constant voltage converter and provide a DC output current to one or more of the LED light sources. The driver circuit further comprises a dimming detection circuit connected to the AC/DC constant voltage converter, the dimming detection circuit configured to detect the dimming control output received by the AC/DC constant voltage converter and provide a dimming control signal to the DC/DC converter, the dimming control signal causing a change in the DC output current provided by the DC/DC converter to the one or more of the LED light sources when the dimming detection circuit detects a change in the dimming control output received by the AC/DC constant voltage converter. The dimming detection circuit is further configured to provide a current control signal to the AC/DC constant voltage converter, the current control signal causing a change in an amount of current consumed by the AC/DC constant voltage converter when the dimming detection circuit detects a change in the dimming control output received by the AC/DC constant voltage converter.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION OF THE DISCLOSED EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1:
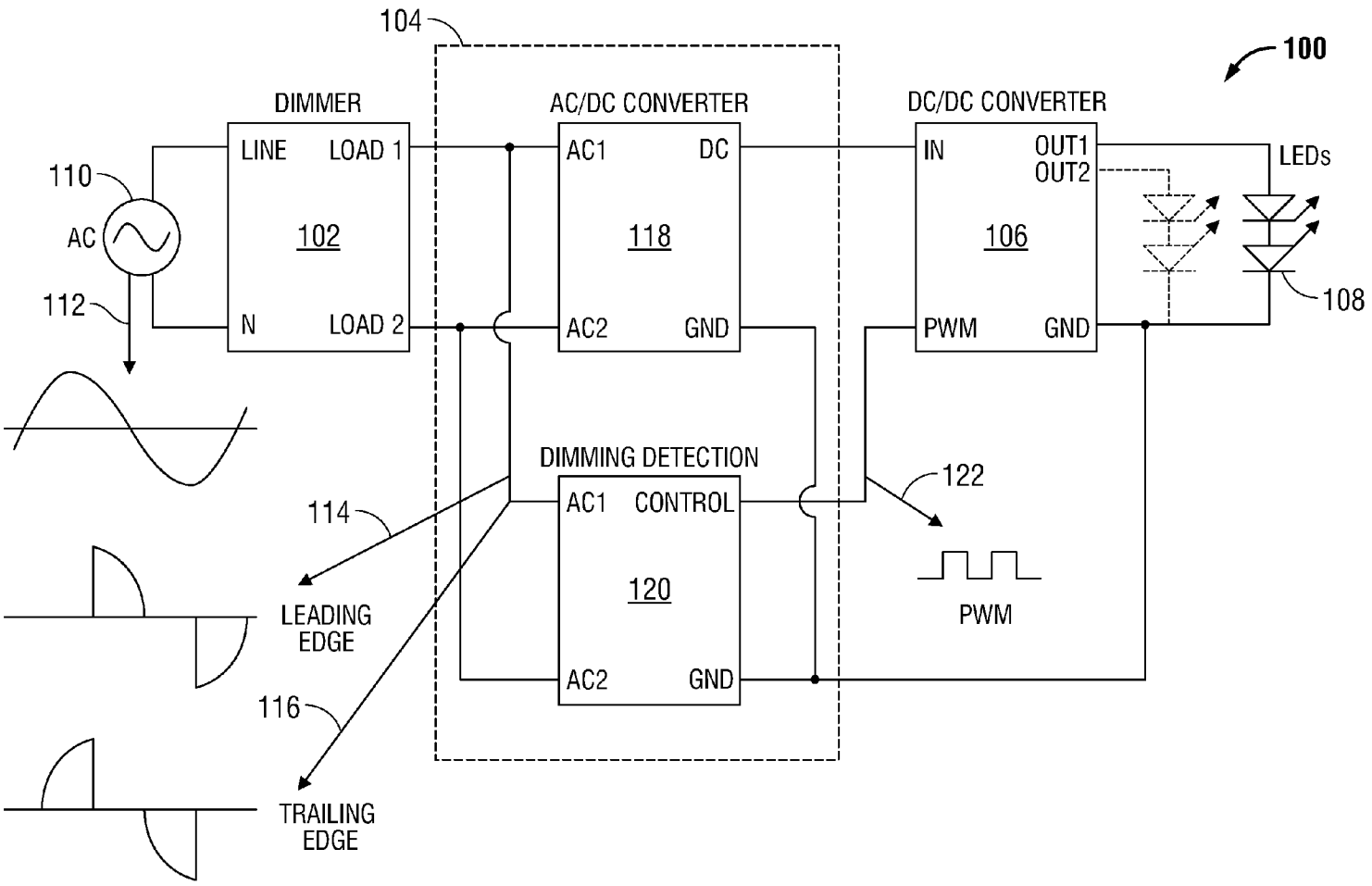
FIG. 1 illustrates an exemplary driver circuit for an LED light array having a dimming control signal according to some implementations of the disclosed embodiments.

Referring now to FIG. 1, an exemplary LED lighting application 100 is shown that can provide dimming control capability despite the use of an AC/DC constant voltage converter 118. Note that although the lighting application is described with respect to LEDs, it should be understood the principles and teachings disclosed herein are equally applicable to any lighting application that requires dimming control, including incandescent, fluorescent, and other non-LED lighting applications.

As can be seen in FIG. 1, the exemplary LED lighting application 100 includes a dimming controller 102, a driver circuit 104, a downstream DC/DC converter 106, and one or more LED arrays 108, all connected to one another in the manner shown. An AC power source 110, such as a standard AC mains, provides AC power to the LED lighting application 100 through the dimming controller 102. Specifically, AC power from the AC power source 110 may be provided through a line terminal ("Line") of the dimming controller 102, while a neutral terminal ("N") of the dimming controller 102 is connected to the neutral line of the AC power source.

Any suitable dimmer may be used for the dimming controller 102 above, including various models of dimmers commercially available from a number of vendors. In general, there are two types of AC output dimmers: leading edge dimmers, and trailing edge dimmers. In a leading edge dimmer, the full AC power received from the AC power source 110, shown at 112, is cut or chopped at the front end of each half wave, resulting in a phase delayed AC output similar to the one shown at 114. In a trailing edge dimmer, the full AC power from the AC power source 110 is cut or chopped at the back end of each half wave, resulting in a phase delayed AC output similar to the one shown at 116.

Figure 2:
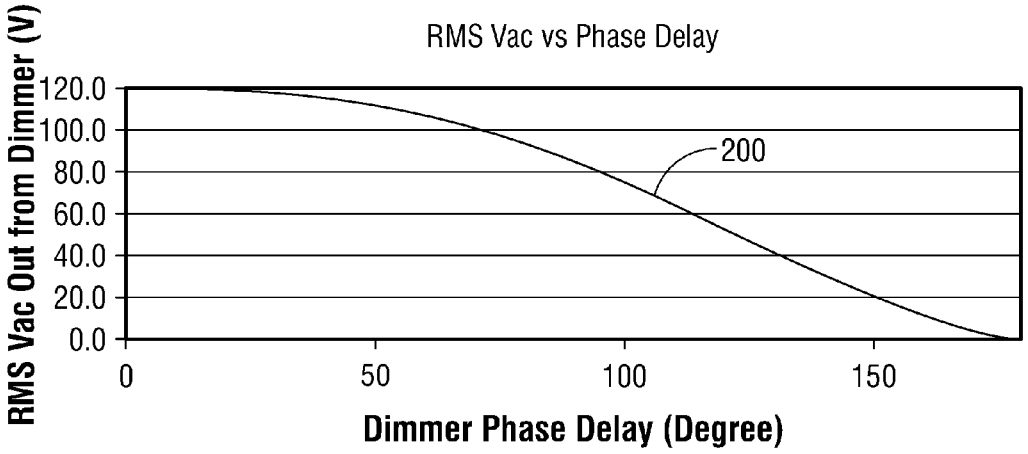
FIG. 2 illustrates an exemplary curve of the relationship between AC voltage and phase delay for a typical dimmer according to some implementations of the disclosed embodiments.

FIG. 2 illustrates an exemplary relationship between the AC output and the phase delay for a typical dimmer. As the line 200 in FIG. 2 shows, in a typical dimmer, the AC output and the phase delay may have an inverse relationship such that increasing the dimmer phase delay causes the RMS value of the AC output to decrease accordingly.

Returning to the example of FIG. 1, the driver circuit 104 to which the AC output from the dimming controller 102 is provided is a special type of driver circuit 104 that is capable of detecting the RMS value of the AC output resulting from the phase cutting operations of the dimming controller 102. In addition, the driver circuit 104 is capable of providing a dimming control signal 122 that reflects, represents, or is otherwise based on the RMS value of the AC output. The dimming control signal 122 may then be provided directly to the downstream DC/DC converter 106 to control dimming of the one or more LED arrays 108.

In some embodiments, the driver circuit 104 may include an AC/DC constant voltage converter 118 configured to receive the AC output from the dimming controller 102. In particular, the AC/DC constant voltage converter 118 may include AC input terminals ("AC1" and "AC2") that are connected to AC output terminals ("Load 1" and "Load 2") of the dimming controller 102. Examples of suitable components that may be used to implement the AC/DC constant voltage converter 118 may include the UCC28700 family of converters from Texas Instruments, Inc., of Dallas, Tex. As well, the AC/DC constant voltage converter 118 may include a DC output terminal ("DC") that is connected to the input terminal ("IN") of the downstream DC/DC converter 106. Examples of suitable components that may be used to implement the downstream DC/DC converter 106 include the TPS92510 converter from Texas Instruments, Inc. The one or more LED arrays 108 may then be connected, respectively, to one or more output terminals ("OUT1" and "OUT2") of the downstream DC/DC converter 106.

As mentioned earlier, the AC/DC constant voltage topology is generally preferred in designing lighting applications, including LED lighting applications, but presents certain challenges in dimming control. Therefore, the driver circuit 104 may further include a dimming detection circuit 120 that may be configured to provide the dimming control signal 122 mentioned above to the downstream DC/DC converter 106 to control dimming of the one or more LED arrays 108. This dimming detection circuit 120 allows the driver circuit 104 to overcome the challenges associated with the AC/DC constant voltage converter 118. In some embodiments, the dimming detection circuit 120 may be an RMS detection circuit configured to detect the RMS value of the AC output from the dimming controller 102, and the dimming control signal 122 provided by the dimming detection circuit 120 may be a PWM signal having a duty cycle that varies in proportion to the RMS value of the AC output from the dimming controller 102.

Referring still to FIG. 1, the dimming detection circuit 120 may include AC input terminals ("AC1" and "AC2") that, like the input terminals of the AC/DC constant voltage converter 118, are connected to the dimming controller 102 as shown to receive the AC output ("Load 1" and "Load 2") of the dimming controller 102. Examples of components that may be used to implement the dimming detection circuit 120 may include any suitable programmable microcontroller, such as the PIC18F5566 microcontroller from Microchip, Inc. of Chandler, Ariz. The output or control terminal ("Control") of the dimming detection circuit 120 may then be connected to the dimming input terminal ("PWM") of the downstream DC/DC converter 106 to provide the dimming control signal 122 directly to the downstream DC/DC converter 106. The dimming detection circuit 120 may thereafter vary the dimming control signal 122 based on the AC output of the dimming controller 102 to increase or decrease the DC output current of the downstream DC/DC converter 106 and thereby increase or decrease the brightness of the one or more LED arrays 108.

Figure 3:
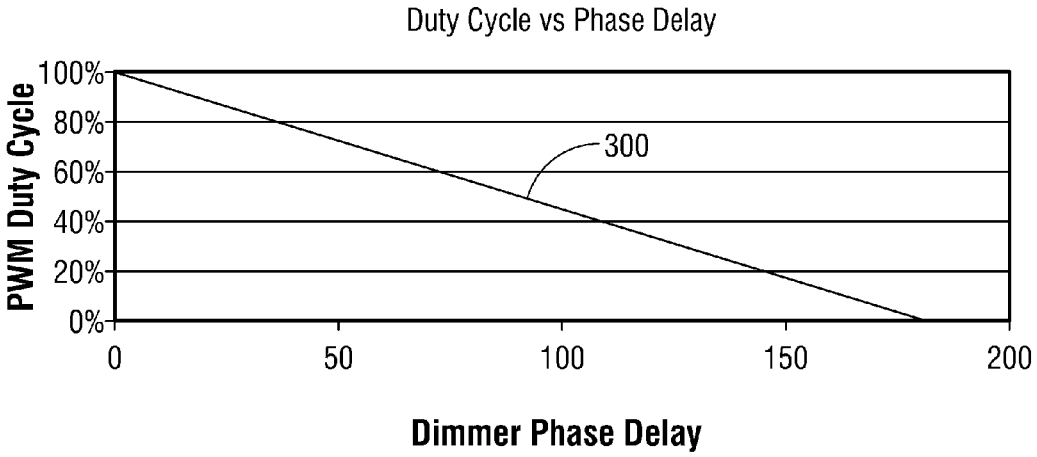
FIG. 3 illustrates an exemplary curve of the relationship between control signal duty cycle and dimmer phase according to some implementations of the disclosed embodiments.

In embodiments where the dimming control signal 122 is a PWM signal, the dimming detection circuit 120 may increase or decrease the DC output current of the downstream DC/DC converter 106 by varying the duty cycle of the PWM signal based on the amount of phase delay in the AC output from the dimming controller 102. FIG. 3 illustrates an example of the relationship between the duty cycle and the phase delay in the AC output from the dimming controller 102 that may be established according to the disclosed embodiments. As the line 300 in FIG. 3 shows, the duty cycle of the dimming control signal 122 and the phase delay of the AC output may have an inverse relationship such that an increase in the phase delay causes a reduction in the duty cycle of the dimming control signal 122, and vice versa.

The above duty cycle-to-phase delay relationship may be implemented in the dimming detection circuit 120 in a number of ways. For example, in some embodiments, the dimming detection circuit 120 may be programmed with an equation based on the relationship shown in FIG. 3. Such an equation may be derived using any known mathematical technique for deriving an equation from a line or curve, including slope-intercept (i.e., $y=mx+b$), curve fitting, finite element analysis, and the like. The dimming detection circuit 120 may then use the equation to calculate the appropriate duty cycle for the dimming control signal 122 given a specific phase delay in the AC output of the dimming controller 102.

Figure 4:
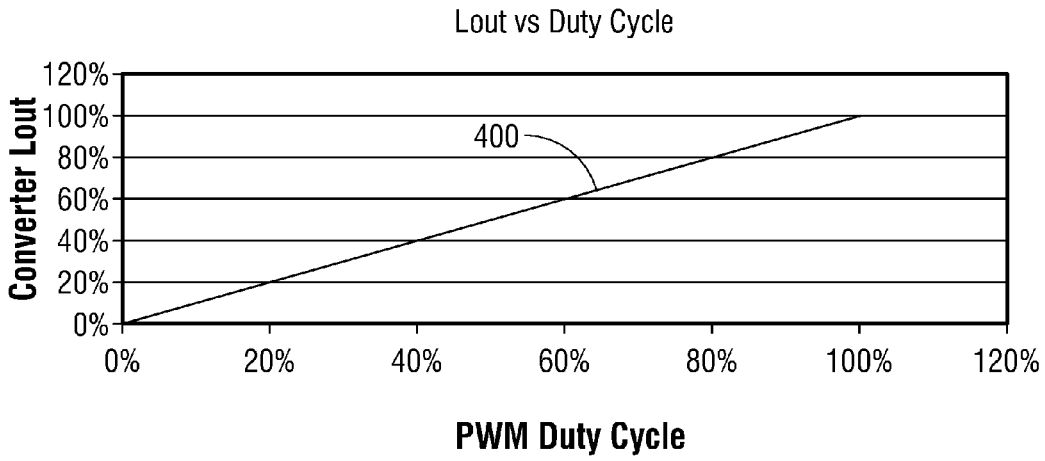
FIG. 4 illustrates an exemplary curve of the relationship between output current and control signal duty cycle according to some implementations of the disclosed embodiments.

Any equation thusly derived should of course account for component-specific characteristics of the specific downstream DC/DC converter 106 used. For example, temperature related shifts, offsets in the DC output current, and the like, should be factored into the equation to ensure that the resulting duty cycle produces a desired DC output current to achieve a target level of dimming. FIG. 4 illustrates an example where the duty cycle of the dimming control signal 122 produces the desired DC output current to achieve the target level of dimming. As depicted by the line 400 in FIG. 4, the duty cycle of the dimming control signal 122 and the DC output current of the downstream DC/DC converter 106 may have a direct relationship such that an increase in the duty cycle causes an increase in the DC output current, and vice versa.

Alternatively, rather than use an equation, in some embodiments, the dimming detection circuit 120 may be programmed with a lookup table for determining duty cycle. The dimming detection circuit 120 may then consult the lookup table as needed to select a specific duty cycle for a given phase delay. The lookup table in some embodiments may be a linear lookup table in which the relationship between the duty cycle and the phase delay may be plotted as a straight line. An example of a linear lookup table is shown in Table 1 below. Such a linear lookup table may be used in conjunction with a leading edge dimming controller 102, though it is also possible to use the table with a trailing edge dimmer controller as well. As is the case with an equation, embodiments that use a lookup table should also account for the characteristics of the specific downstream DC/DC converter 106 used.

TABLE 1

| Dimmer Phase Delay (degree) | Duty Cycle (%) |
|---|---|
| 0 | 100 |
| 10 | 94 |
| 20 | 89 |
| 30 | 83 |
| 40 | 78 |
| 50 | 72 |
| 60 | 67 |
| 70 | 61 |
| 80 | 56 |
| 90 | 50 |
| 100 | 44 |
| 110 | 39 |
| 120 | 33 |
| 130 | 28 |
| 140 | 22 |
| 150 | 17 |
| 160 | 11 |
| 170 | 6 |
| 180 | 0 |

In some embodiments, instead of a linear lookup table, the dimming detection circuit 120 may be programmed with a non-linear lookup table that would result in a curved line if its duty cycle-to-phase delay relationship were plotted. An example of a non-linear lookup table is shown in Table 2 below. It is contemplated this non-linear lookup table may be employed in conjunction with a trailing edge dimming controller 102, but the table may certainly be used with a leading edge dimmer controller if needed.

TABLE 2

| Dimmer phase delay (degree) | Duty cycle (%) |
|---|---|
| 0 | 100 |
| 10 | 90 |
| 20 | 80 |
| 30 | 85 |
| 40 | 70 |
| 50 | 85 |
| 60 | 85 |
| 70 | 60 |
| 80 | 55 |
| 90 | 40 |
| 100 | 40 |
| 110 | 50 |
| 120 | 58 |
| 130 | 35 |
| 140 | 30 |
| 150 | 30 |
| 160 | 25 |
| 170 | 25 |
| 180 | 10 |

In some embodiments, rather than varying the duty cycle of the dimming control signal 122, it is possible to use a fixed duty cycle and instead vary the frequency of the dimming control signal 122 with the phase delay of the AC output. An example of a linear frequency-based lookup table is shown below in Table 3.

TABLE 3

| Dimmer phase delay (degree) | Frequency (KHz) |
|---|---|
| 0 | 19 |
| 10 | 18 |
| 20 | 17 |
| 30 | 16 |
| 40 | 15 |
| 50 | 14 |
| 60 | 13 |
| 70 | 12 |
| 80 | 11 |
| 90 | 10 |
| 100 | 9 |
| 110 | 8 |
| 120 | 7 |
| 130 | 6 |
| 140 | 5 |
| 150 | 4 |
| 160 | 3 |
| 170 | 2 |
| 180 | 1 |

As well, an exemplary non-linear frequency-based lookup table is shown in Table 4 below.

TABLE 4

| Dimmer phase delay (degree) | Frequency (KHz) |
|---|---|
| 0 | 19 |
| 10 | 18 |
| 20 | 18 |

TABLE 4-continued

| Dimmer phase delay (degree) | Frequency (KHz) |
|---|---|
| 30 | 18 |
| 40 | 17 |
| 50 | 15 |
| 60 | 16 |
| 70 | 17 |
| 80 | 18 |
| 90 | 12 |
| 100 | 10 |
| 110 | 9 |
| 120 | 9 |
| 130 | 10 |
| 140 | 10 |
| 150 | 5 |
| 160 | 3 |
| 170 | 3 |
| 180 | 1 |

As with their duty cycle-based counterparts in Tables 1 and 2, the frequency-based lookup Tables 3 and 4 above may be used with either a leading edge dimming controller 102 or a trailing edge dimming controller 102 without departing from the scope of the disclosed embodiments. And the values in all of these Tables 1-4 may be derived using any methodology known to those having ordinary skill in the art, including by experimental trial and error, statistical modeling and simulation, observing and tracking actual usage in the field, and the like.

General operation of the dimming detection circuit 120 is described below with respect to FIG. 5 via a flowchart 500. Although the flow chart 500 shows a number of discrete blocks, it should be understood that any block may be divided into two more constituent blocks, and that two or more blocks may be combined to form a single block, without departing from the scope of the exemplary disclosed embodiments. Also, although the various blocks are arranged in a particular sequence in FIG. 5, it should be understood that one or more of the blocks may be performed outside the sequence shown, or omitted altogether in some cases, without departing from the scope of the exemplary disclosed embodiments.

Figure 5:
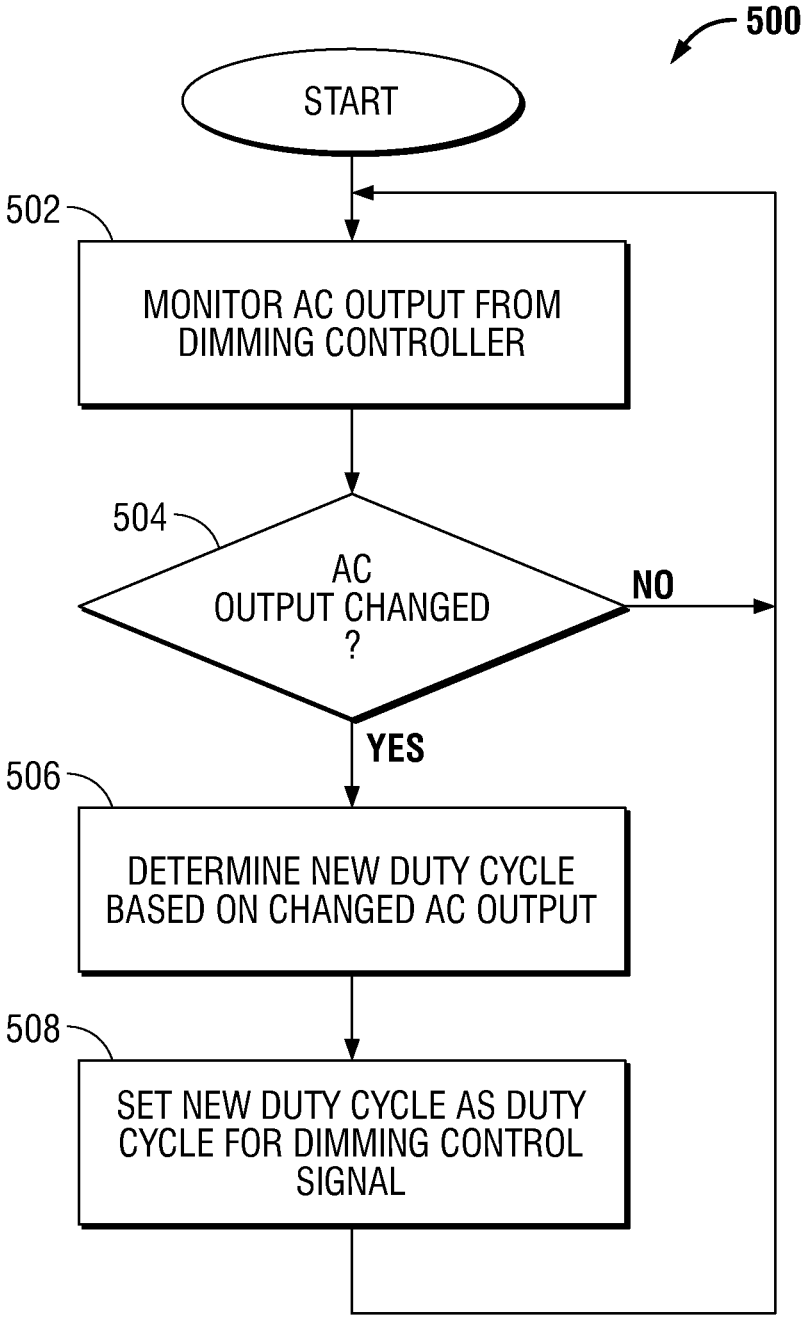
FIG. 5 illustrates an exemplary flow chart for a method of setting a duty cycle for a dimming control signal according to some implementations of the disclosed embodiments.

As can be seen in FIG. 5, in general, operation of the dimming detection circuit begins at block 502, where the dimming detection circuit monitors the AC output from the dimming controller. At block 504, a determination is made as to whether the phase delay of the AC output has changed, for example, increased or decreased by a predefined minimum threshold phase delay. Such change in the phase delay may be detected, as discussed above, by determining the RMS value of the AC output. Any suitable minimum threshold phase delay may be used, including one degree, two degrees, three degrees, and so forth, depending on the particular aims of the application.

If the determination at block 504 is negative, meaning the minimum threshold amount was not exceeded, then the dimming detection circuit returns to block 502 in order to continue monitoring the AC output. On the other hand, if the determination at block 504 is affirmative, then the dimming detection circuit determines a new duty cycle for the dimming control signal at block 506 based on the change in the phase delay of the AC output. The new duty cycle may be determined using any of the techniques discussed above, including calculating the new duty cycle using an equation, looking up the new duty cycle using a duty cycle-based linear lookup table, or looking up the new duty cycle using a duty cycle-based non-linear lookup table.

In embodiments where the dimming control signal has a fixed duty cycle, the dimming detection circuit may determine a new frequency instead of a new duty cycle for the dimming control signal based on the change in the phase delay of the AC output. The new frequency may be determined using any of the techniques discussed above, including calculating the new frequency, looking up the new frequency using a linear frequency-based lookup table, or looking up the new frequency using a non-linear frequency-based lookup table.

Next, at block 508, the dimming detection circuit sets the new duty cycle as the duty cycle for the dimming control signal. If dimming control signal has a fixed duty cycle, then dimming detection circuit sets the new frequency as the frequency of the dimming control signal. The dimming detection circuit thereafter returns to block 502 to continue monitoring the AC output of the dimming controller.

In some embodiments, in addition to a dimming detection circuit 120 having a dimming control signal 122, enhancements may also be made to the AC/DC constant voltage converter 118 of the driver circuit 104. Recall from the discussion above that the AC/DC constant voltage converter 118 will try to draw more current from the dimming controller 102 in order to offset the decrease in the AC output during dimming, and that this increased current may cause the current rating of the dimming controller 102 to be exceeded in some cases, potentially damaging the dimming controller 102 over time.

Figure 6:
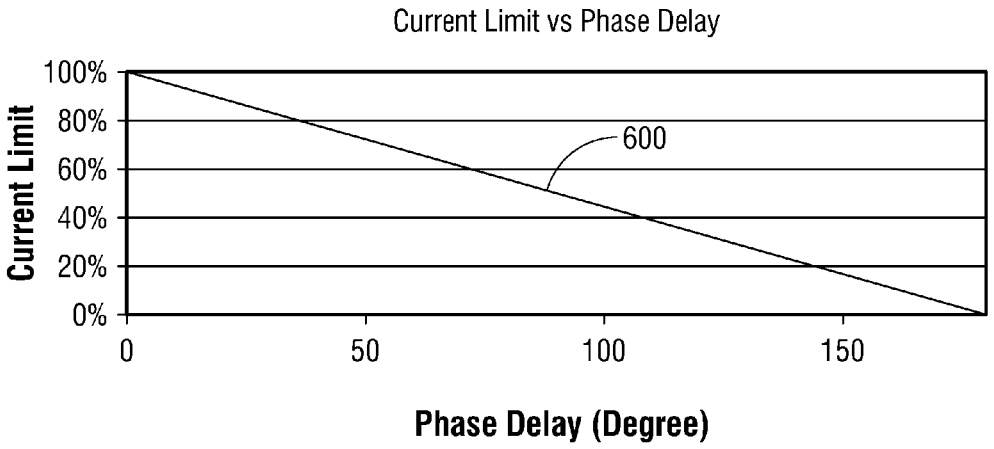
FIG. 6 illustrates an exemplary curve of the relationship between current limit and dimmer phase delay for an AC/DC constant voltage converter according to some implementations of the disclosed embodiments.

In accordance with the disclosed embodiments, the AC/DC constant voltage converter 118 may be programmed to self-limit the amount of current it draws from the dimming controller 102 based on the phase delay of the AC output from the dimming controller 102. FIG. 6 illustrates an example of the relationship between the current limit and the phase delay in the AC output from the dimming controller 102 that may be established according to the disclosed embodiments. As the line 600 in FIG. 6 shows, the current limit of the AC/DC constant voltage converter 118 and the phase delay of the AC output may have an inverse relationship such that an increase in the phase delay causes a reduction in the current limit of the AC/DC constant voltage converter 118, and vice a versa.

Figure 7:
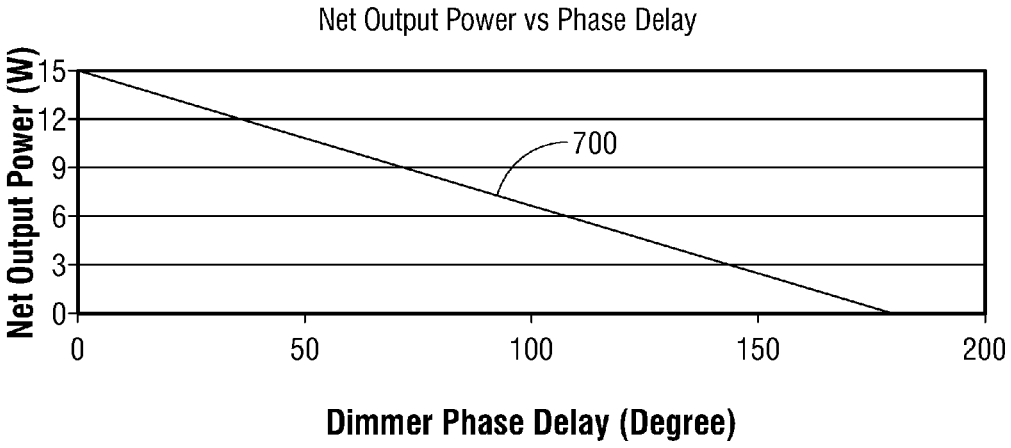
FIG. 7 illustrates an exemplary curve of the relationship between power output and dimmer phase delay for an AC/DC constant voltage converter according to some implementations of the disclosed embodiments.

The relationship shown in FIG. 6 may then the used to limit the current in the AC/DC constant voltage converter 118 in several ways. For example, in some embodiments, an equation may be programmed in the AC/DC constant voltage converter 118 based on the relationship shown in FIG. 6. Any equation used should of course account for component-specific characteristics of the specific AC/DC constant voltage converter 118 used so that the resulting current limits provide appropriate protection for the dimming controller 102 from excessive current consumption. FIG. 7 illustrates an example in which the current limits of the AC/DC constant voltage converter 118 adequately protect the dimming controller 102. As illustrated by the line 700 in FIG. 7, the phase delay of the dimming controller 102 (which is a proxy for the current limits of the AC/DC constant voltage converter 118) and the net output power from the dimming controller 102 may have an inverse relationship such that an increase in the phase delay of the AC output causes a reduction in the net output power of the dimming controller 102, and vice versa.

It is also possible to use a lookup table instead of an equation to limit the current in the AC/DC constant voltage converter 118 in some embodiments. An example of a lookup table that may be programmed in the AC/DC constant voltage converter 118 is shown in Table 5 below. Such a lookup table may be used with either leading edge or trailing edge dimming controllers 102, and may be derived using any methodology known to those having ordinary skill in the art, including experimentally, statistically, observationally, and the like.

TABLE 5

| Dimmer Phase delay (Degree) | Output Voltage (V) | Current Limit (mA) | Net Output Power (W) |
|---|---|---|---|
| 0 | 15 | 1000 | 15.0 |
| 10 | 15 | 944 | 14.2 |
| 20 | 15 | 889 | 13.3 |
| 30 | 15 | 833 | 12.5 |
| 40 | 15 | 778 | 11.7 |
| 50 | 15 | 722 | 10.8 |
| 60 | 15 | 667 | 10.0 |
| 70 | 15 | 611 | 9.2 |
| 80 | 15 | 556 | 8.3 |
| 90 | 15 | 500 | 7.5 |
| 100 | 15 | 444 | 6.7 |
| 110 | 15 | 389 | 5.8 |
| 120 | 15 | 333 | 5.0 |
| 130 | 15 | 278 | 4.2 |
| 140 | 15 | 222 | 3.3 |
| 150 | 15 | 167 | 2.5 |
| 160 | 15 | 111 | 1.7 |
| 170 | 15 | 56 | 0.8 |
| 180 | 15 | 0 | 0.0 |

Figure 8:
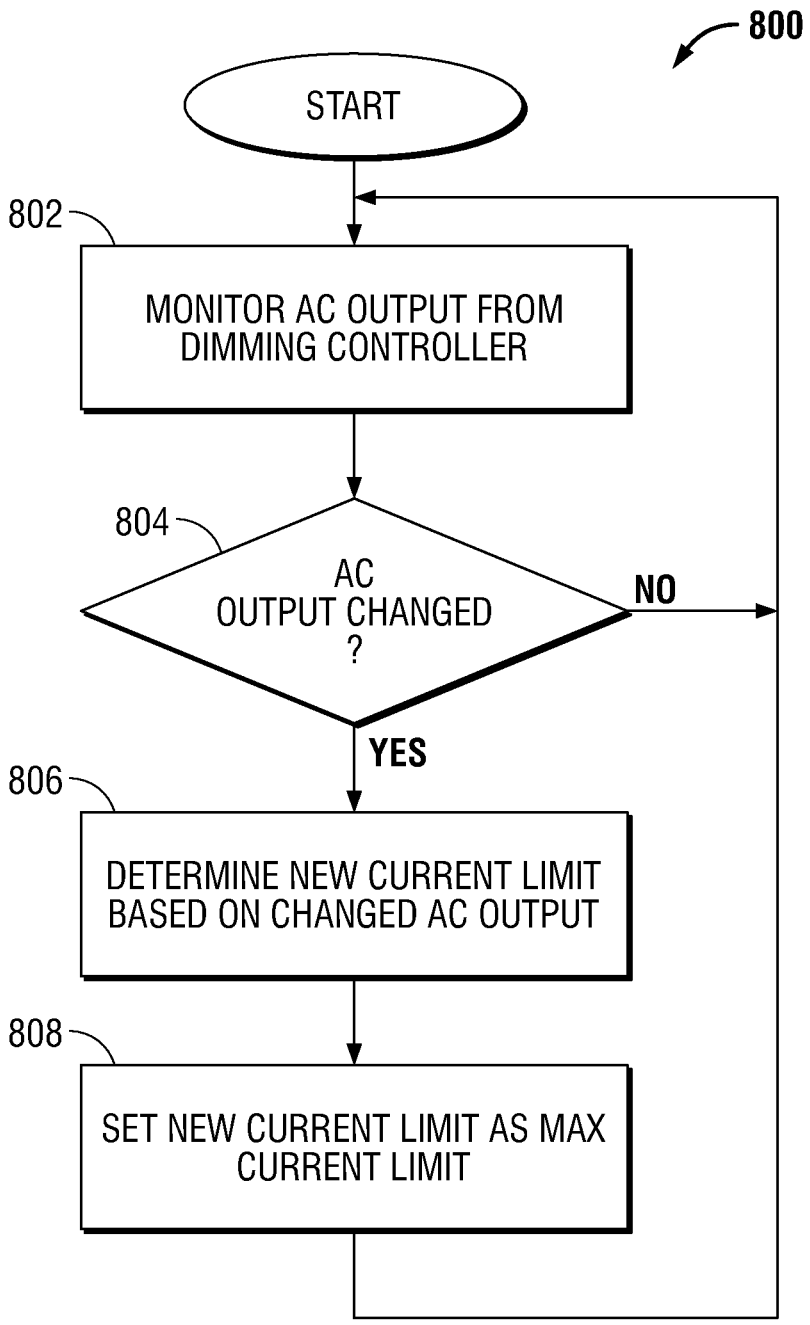
FIG. 8 illustrates an exemplary flow chart for a method of setting an output current limit of an AC/DC constant voltage converter according to some implementations of the disclosed embodiment.

General operation of the AC/DC constant voltage converter 118 is described below with respect to FIG. 8 via a flowchart 800. As can be seen in FIG. 8, operation of the AC/DC constant voltage converter begins at block 802, where the AC/DC constant voltage converter monitors the AC output from the dimming controller. At block 804, a determination is made as to whether the phase delay of the AC output has changed by a predefined minimum threshold phase delay based, for example, on the RMS value of the AC output. If the determination at block 804 negative, then the AC/DC constant voltage converter returns to block 802 to continue monitoring the AC output. If the determination at block 804 is affirmative, then the AC/DC constant voltage converter determines a new current limit for itself at block 806 based on the change in the phase delay of the AC output. The new current limit may be determined using any of the techniques discussed above, including by calculating the limit, looking up the limit, and the like. Next, at block 808, the AC/DC constant voltage converter sets the new current limit as the current limit for itself. The AC/DC constant voltage converter thereafter returns to block 802 to continue monitoring the AC output of the dimming controller.

Figure 9:
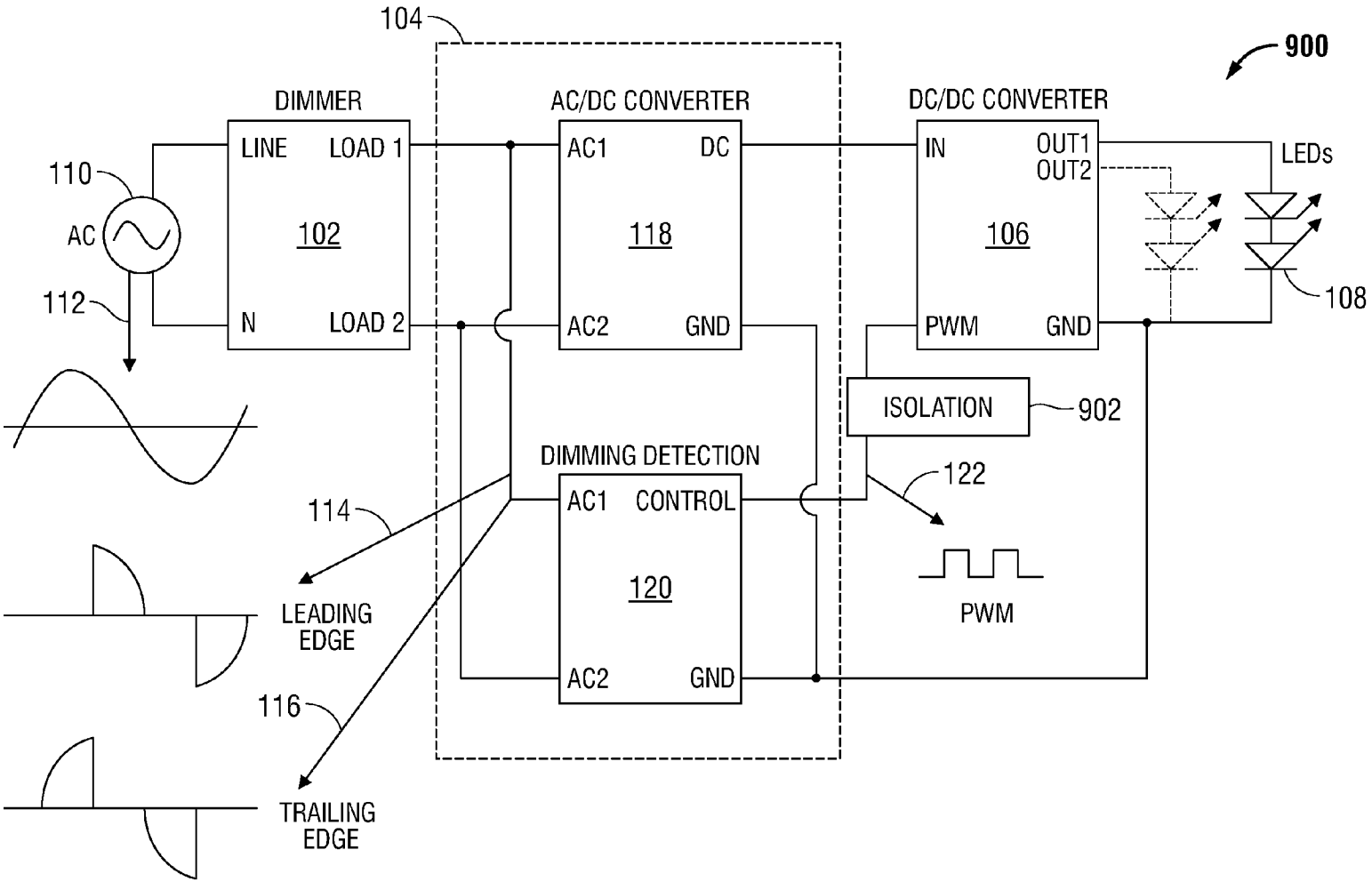
FIG. 9 illustrates an exemplary isolated driver circuit for an LED light array having a dimming control signal according to some implementations of the disclosed embodiments.

FIG. 9 illustrates another exemplary LED lighting application 900 in accordance with the disclosed embodiments. The LED lighting application 900 in FIG. 9 is similar to the LED lighting application 100 in FIG. 1, except that the output or control terminal ("Control") of the dimming detection circuit 120 is connected to the dimming input terminal ("PWM") of the downstream DC/DC converter 106 through an optical-isolator 902 rather than directly. The optical-isolator 902 provides physical isolation for the downstream DC/DC converter 106 as a safety measure, for example, to prevent any unwanted feedback to the dimming detection circuit 120. Any suitable optical-isolator or other isolation device may be used for the optical-isolator 902 without departing from the embodiments disclosed herein.

Figure 10:
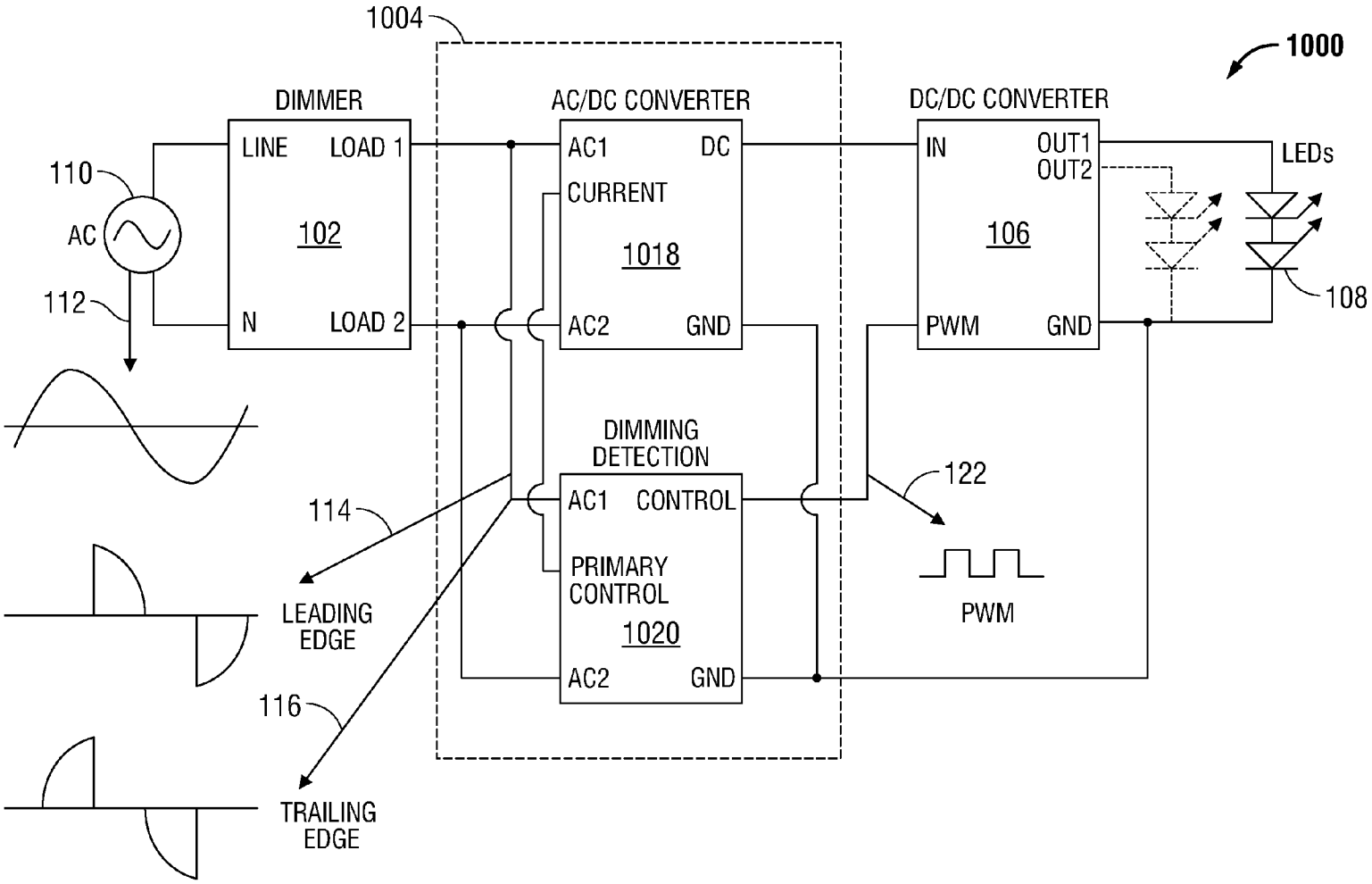
FIG. 10 illustrates an exemplary driver circuit for an LED light array having a dimming control signal and a primary side control signal according to some implementations of the disclosed embodiments.

FIG. 10 illustrates yet another LED lighting application 1000 in accordance with the disclosed embodiments. This LED lighting application 1000 has a modified driver circuit 1004, but is similar in all other aspects to the LED lighting application 100 in FIG. 1. The modified driver circuit 1004 includes a modified AC/DC constant voltage converter 1018 and a modified dimming detection circuit 1020. The modified AC/DC constant voltage converter 1018 operates in much the same way as its counterpart in FIG. 1, except that it has not been programmed to self-limit the amount of current it consumes during dimming. Instead, current consumption by the modified AC/DC constant voltage converter 1018 during dimming may be controlled by the modified dimming detection circuit 1020. This modified dimming detection circuit 1020 functions in much the same way as its counterpart in FIG. 1, but has an additional feature in that it can generate a primary side control signal through its primary side control terminal ("Primary Control"). The primary side control signal may then be connected to a primary side current control terminal ("Current") of the modified AC/DC constant voltage converter 1018 to limit the amount of current drawn by the AC/DC constant voltage converter 1018 during dimming. This current control terminal ("Current") may be the VS terminal in embodiments that implement the modified AC/DC constant voltage converter 1018 using the UCC28700 family of converters from Texas Instruments, Inc. In such embodiments, the primary side control signal may be a PWM signal similar to the dimming control signal 122 discussed above, and may also be derived using the same techniques as the dimming control signal 122 discussed above (i.e., using an equation, a linear lookup table, a non-linear lookup table, etc.).

Figure 11:
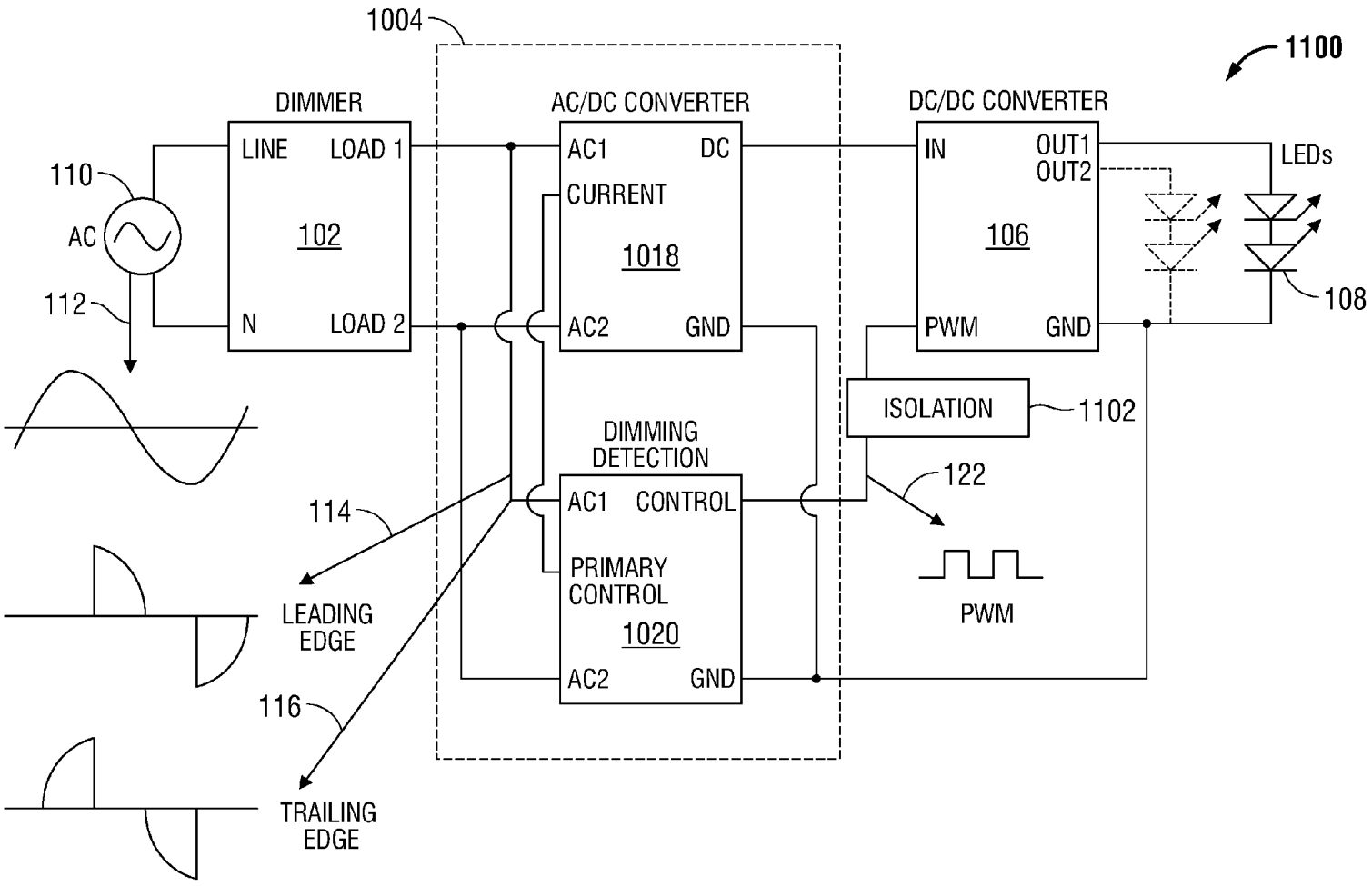
FIG. 11 illustrates an exemplary isolated driver circuit for an LED light array having a dimming control signal and a primary side control signal according to some implementations of the disclosed embodiments.

FIG. 11 illustrates still another LED lighting application 1100 according to the disclosed embodiments. This LED lighting application 1100 is otherwise similar to the LED lighting application 1000 in FIG. 10, except that the output or control terminal ("Control") of the dimming detection circuit 1020 is connected to the dimming input terminal ("PWM") of the downstream DC/DC converter 106 through an optical-isolator 1102 rather than directly.

Figure 12:
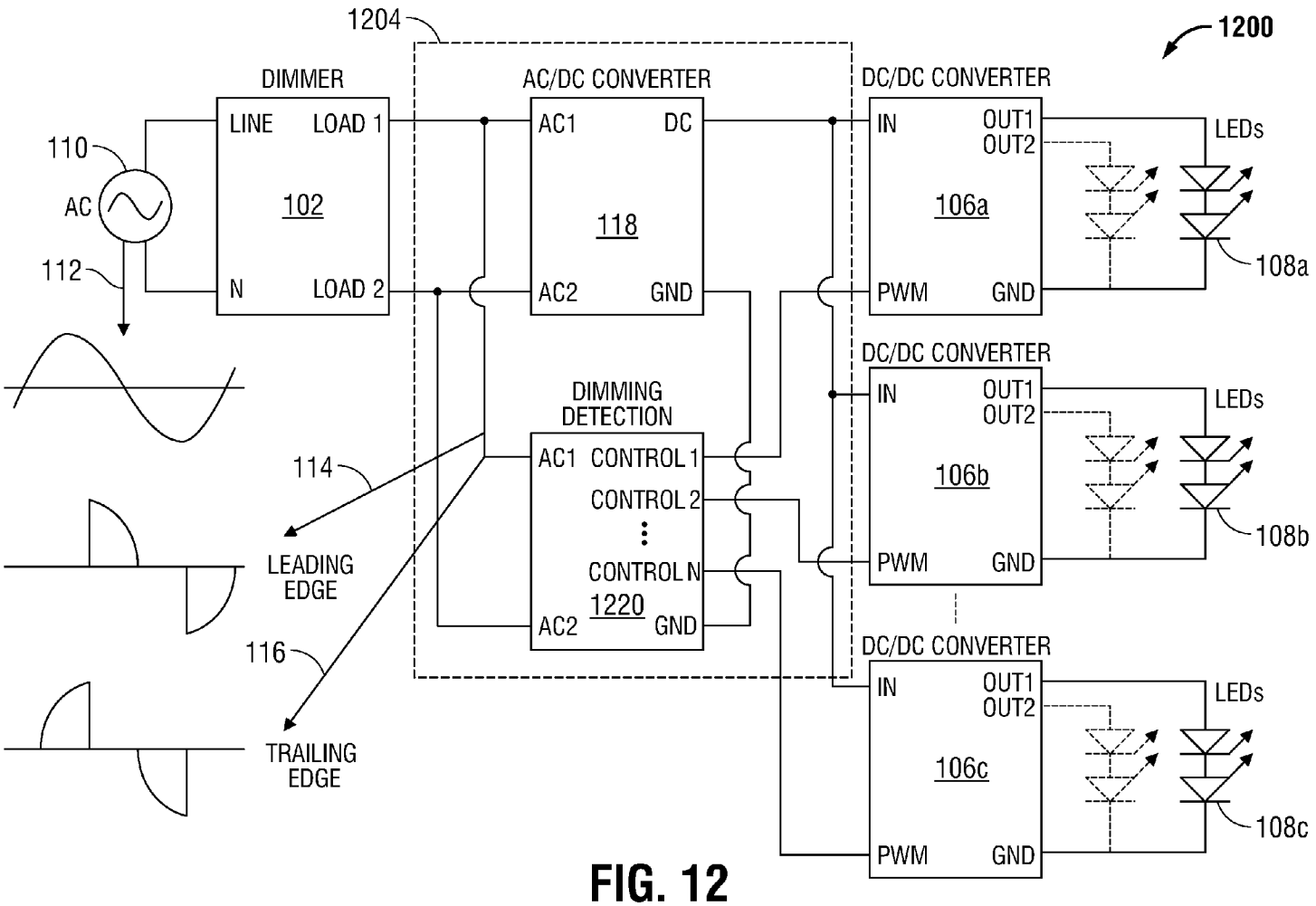
FIG. 12 illustrates an exemplary driver circuit for an LED light array having multiple dimming control signals according to some implementations of the disclosed embodiment.

FIG. 12 illustrates yet another LED lighting application 1200 according to the disclosed embodiments. This LED lighting application 1200 has another modified driver circuit 1204 that is similar in all other aspects to the modified driver circuit 1004 of FIG. 10, except the modified dimming detection circuit 1220 has multiple output or control terminals ("Control"), each capable of being configured to provide a separate dimming control signal. Multiple downstream DC/DC converters 106*a*, 106*b*, and 106*c*, each being connected to one or more LED arrays 108*a*, 108*b*, and 108*c*, may then receive the various dimming control signals at their respective dimming input terminals ("PWM") to increase or decrease the DC output currents to the one or more LED arrays 108*a*, 108*b*, and 108*c*.

Figure 13:
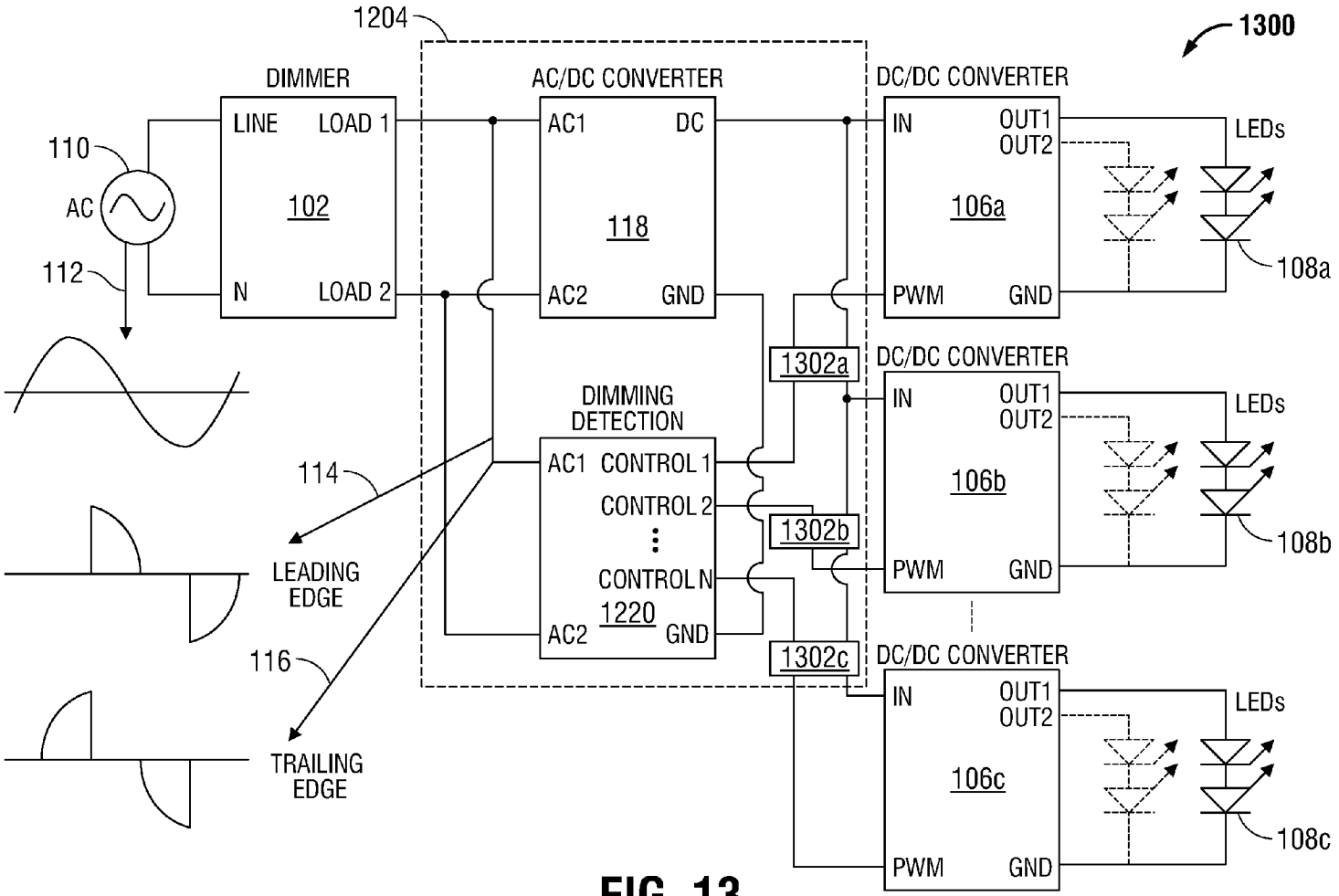
FIG. 13 illustrates an exemplary isolated driver circuit for an LED light array having multiple dimming control signals according to some implementations of the disclosed embodiments.

FIG. 13 illustrates still another LED lighting application 1300 according to the disclosed embodiments. This LED lighting application 1300 is otherwise similar to the LED lighting application 1200 in FIG. 12, except that the output or control terminals ("Control") of the dimming detection circuit 1220 are connected to the dimming input terminals ("PWM") of the downstream DC/DC converters 106*a*, 106*b*, and 106*c* through optical-isolators 1302*a*, 1302*b*, and 1302*c* rather than directly.

Figure 14:
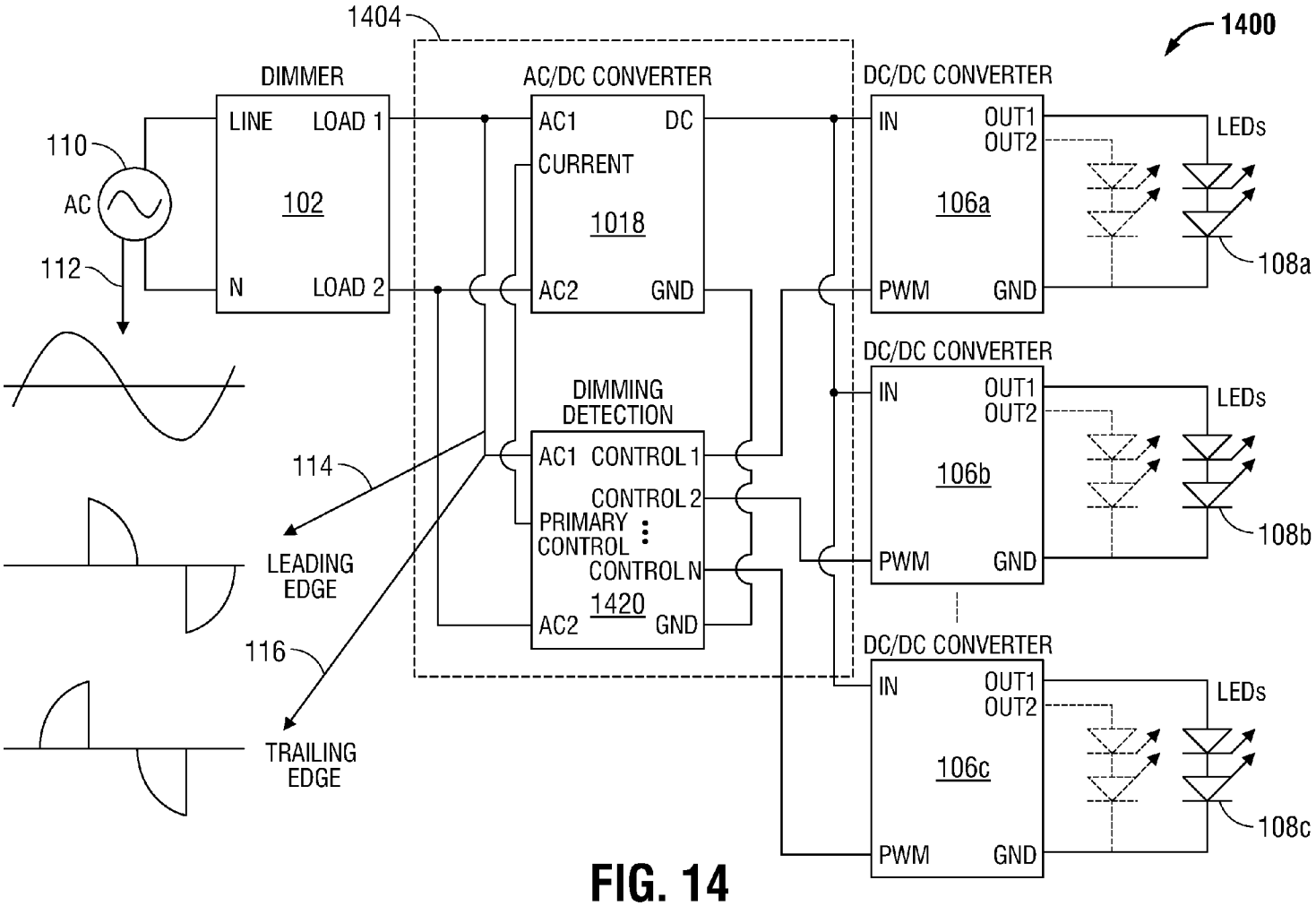
FIG. 14 illustrates an exemplary driver circuit for an LED light array having multiple dimming control signals and a primary side control signal according to some implementations of the disclosed embodiment.

FIG. 14 illustrates yet another LED lighting application 1400 according to the disclosed embodiments. This LED lighting application 1400 has yet another modified driver circuit 1404 that is similar in all other aspects to the driver circuit 1004 of the LED lighting application 1000 in FIG. 10, except that the modified dimming detection circuit 1420 has multiple output or control terminals ("Control"), each capable of being configured to provide a separate dimming control signal. Multiple downstream DC/DC converters 106*a*, 106*b*, and 106*c*, each being connected to one or more LED arrays 108 108*a*, 108*b*, and 108*c*, may then receive the various dimming control signals at their respective dimming input terminals ("PWM") to increase or decrease the DC output currents to the one or more LED arrays 108*a*, 108*b*, and 108*c*.

Figure 15:
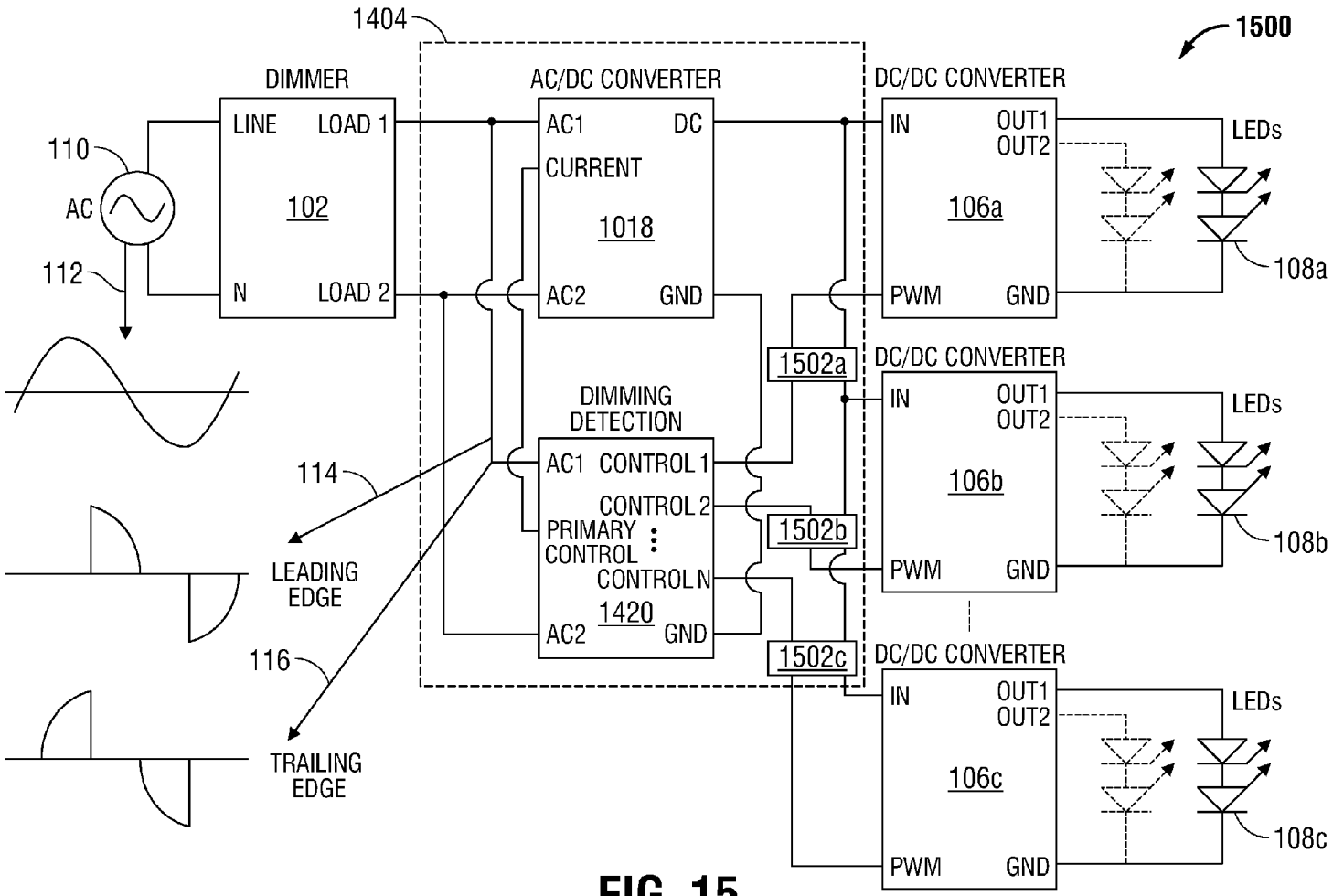
FIG. 15 illustrates an exemplary isolated driver circuit for an LED light array having multiple dimming control signals and a primary side control signal according to some implementations of the disclosed embodiments.

FIG. 15 illustrates still another LED lighting application 1500 according to the disclosed embodiments. This LED lighting application 1500 is otherwise similar to the LED lighting application 1400 in FIG. 14, except that the multiple output or control terminals ("Control") of the modified dimming detection circuit 1420 are connected to the dimming input terminals ("PWM") of the downstream DC/DC converters 106*a*, 106*b*, and 106*c* through optical-isolator 1502*a*, 1502*b*, and 1502*c* rather than directly.

Thus far, the disclosed embodiments have been discussed with respect to a dimming controller 102 that uses an AC output to control dimming. However, other dimming controllers exist that use a DC output instead to control dimming. These DC output dimming controllers, like their AC output counterpart, are commercially available from a number of vendors and any suitable DC output dimming controllers may be used.

Figure 16:
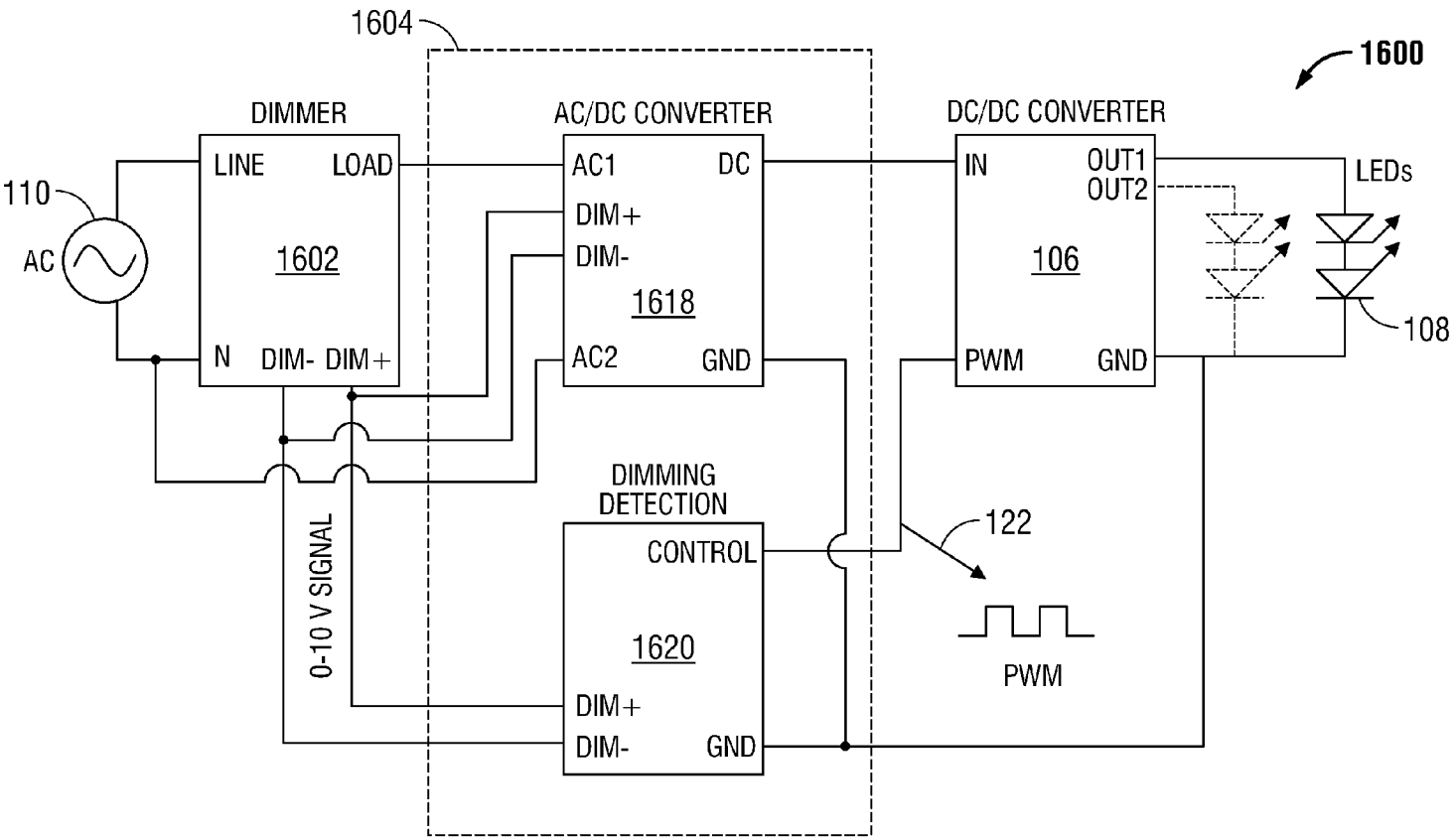
FIG. 16 illustrates another exemplary driver circuit for an LED light array having a dimming control signal according to some implementations of the disclosed embodiments.

FIG. 16 shows an exemplary LED lighting application 1600 in which a DC output dimming controller is used. This exemplary LED lighting application 1600 includes a DC output dimming controller 1602 and a special driver circuit 1604 connected to the dimming controller 1602. The remaining components of the LED lighting application 1600, including the downstream DC/DC converter 106, the one or more LED arrays 108, and the AC power source 110 may be the same as or similar to the ones shown in FIG. 1. The AC power source 110 provides AC power to the LED lighting application 1600 through the dimming controller 1602 via a line terminal ("Line") of the dimming controller 1602, while a neutral terminal ("N") of the dimming controller 1602 is connected to the neutral line of the AC power source. The DC output of the dimming controller 1602 is provided through DC output terminals ("DIM+" and "DIM−") for controlling dimming. This DC output is typically a DC voltage and normally ranges from about 0 VDC to about 10 VDC (within ±10 percent), although dimming controllers having a different DC voltage range may certainly be used without departing from the scope of the disclosed embodiments.

In FIG. 16, the driver circuit 1604 to which the DC output from the dimming controller 1602 is provided is a custom driver circuit that is capable of detecting the DC output from the dimming controller 1602. Specifically, the driver circuit 1604 is configured to monitor the DC output from the dimming controller 1602 and provide a dimming control signal 122 that reflects, represents, or is otherwise based on the voltage level of the DC output from the dimming controller 1602. The driver circuit 1604 then provides this dimming control signal 122 directly to the downstream DC/DC converter 106 to control dimming of the one or more LED arrays 108.

As with its counterpart in FIG. 1, the driver circuit 1604 may include an AC/DC constant voltage converter 1618 configured to receive the DC output from the dimming controller 1602. In particular, the AC/DC constant voltage converter 1618 may include AC input terminals ("AC1" and "AC2") that are connected to the load and neutral terminals ("Load" and "N") of the dimming controller 1602. In addition, the AC/DC constant voltage converter 1618 may also include DC input terminals ("DIM+" and "DIM−") that are connected to the corresponding DC output terminals of the dimming controller 1602. Examples of suitable components that may be used to implement the AC/DC constant voltage converter 1618 may include the UCC28700 family of converters from Texas Instruments, Inc., of Dallas, Tex. And as before, the AC/DC constant voltage converter 1618 may include a DC output terminal ("DC") that is connected to the input terminal ("IN") of the downstream DC/DC converter 106.

The driver circuit 1604 may further include a dimming detection circuit 1620 that may be configured to provide the dimming control signal 122 mentioned above to the downstream DC/DC converter 106 to control dimming of the one or more LED arrays 108. This dimming detection circuit 1620 is configured to detect the DC output of the dimming controller 1602 and provide the dimming control signal 122 to the downstream DC/DC converter 106. As before, the dimming control signal 122 provided by the dimming detection circuit 1620 may be a PWM signal having a duty cycle that varies in proportion to the DC output from the dimming controller 1602.

Referring still to FIG. 16, the dimming detection circuit 1620 may include DC input terminals ("DIM+" and "DIM−") that, like the DC input terminals of the AC/DC constant voltage converter 1618, are connected to the DC output terminals of the dimming controller 1602. Examples of components that may be used to implement the dimming detection circuit 1620 may include any suitable programmable microcontroller, such as the PIC18F5566 microcontroller from Microchip, Inc. of Chandler, Ariz. The output or control terminal ("Control") of the dimming detection circuit 1620 may then be connected to the dimming input terminal ("PWM") of the downstream DC/DC converter 106 to provide the dimming control signal 122 directly to the downstream DC/DC converter 106. The dimming detection circuit 1620 may thereafter vary the dimming control signal 122 based on the DC output of the dimming controller 1602 to increase or decrease the DC output current of the downstream DC/DC converter 106 and thereby increase or decrease the brightness of the one or more LED arrays 108.

Figure 17:
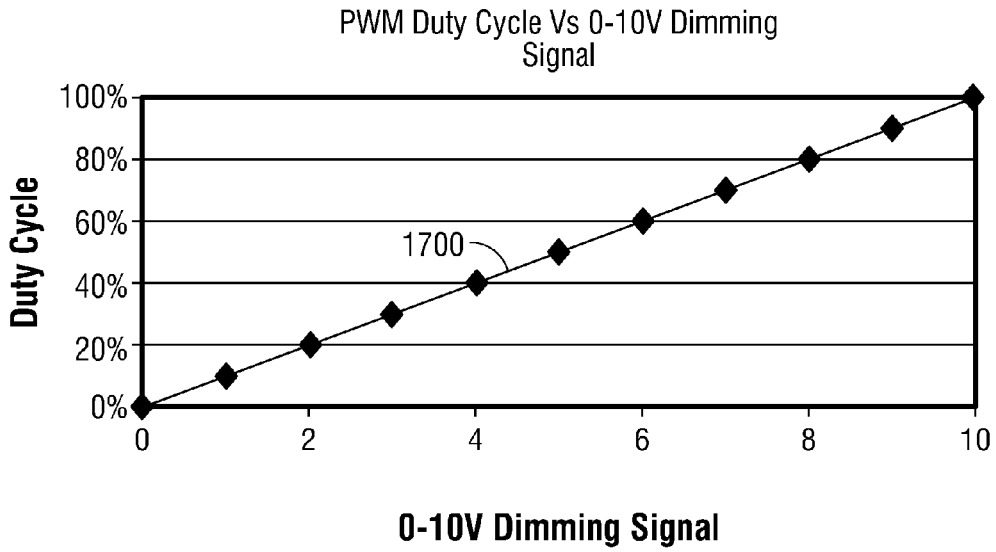
FIG. 17 illustrates an exemplary curve of the relationship between control signal duty cycle and dimmer voltage according to some implementations of the disclosed embodiments.

In some embodiments, the dimming detection circuit 1620 may increase or decrease the DC output current of the downstream DC/DC converter 106 by varying the duty cycle of the PWM signal based on the voltage level of the DC output from the dimming controller 1602. An example of the relationship between the duty cycle and the voltage level of the DC output from the dimming controller 1602 that may be used in some embodiments is depicted in FIG. 17. In this figure, line 1700 represents the relationship between the duty cycle of the dimming control signal 122 and the voltage level of the DC output, which ranges from 0 VDC to 10 VDC in the present example. As can be seen, the line shows a proportional relationship such that an increase in the voltage level of the DC output causes an increase in the duty cycle of the dimming control signal 122, and vice versa.

The above duty cycle-to-voltage level relationship may be implemented in the dimming detection circuit 1620 in several ways. In some embodiments, the dimming detection circuit 1620 may be programmed with an equation based on the relationship shown in FIG. 17. The equation may be derived using any established mathematical technique for deriving an equation from a line or curve, including slope-intercept (i.e., y=mx+b), curve fitting, finite element analysis, and the like. The dimming detection circuit 1620 may then use the equation to calculate the appropriate duty cycle for the dimming control signal 122 given a specific voltage level of the DC output of the dimming controller 1602.

In some embodiments, instead of an equation, the dimming detection circuit 1620 may be programmed with a duty cycle lookup table. The dimming detection circuit 1620 may then refer to the lookup table as needed to select a specific duty cycle for a given voltage level of the DC output. An example of a linear lookup table is shown in Table 6 below.

TABLE 6

| Dimmer DC Voltage (V) | Duty Cycle (%) |
|---|---|
| 10 | 100 |
| 9 | 90 |
| 8 | 80 |
| 7 | 70 |
| 6 | 60 |
| 5 | 50 |
| 4 | 40 |
| 3 | 30 |
| 2 | 20 |
| 1 | 10 |
| 0 | 0 |

In some embodiments, instead of a linear lookup table, the dimming detection circuit 1620 may be programmed with a non-linear lookup table. An example of a non-linear lookup table is shown in Table 7 below with non-linearities at 8-9 V and 3-6 V.

TABLE 7

| Dimmer DC Voltage (V) | Duty cycle (%) |
|---|---|
| 10 | 100 |
| 9 | 90 |
| 8 | 90 |
| 7 | 80 |
| 6 | 70 |
| 5 | 70 |
| 4 | 50 |
| 3 | 60 |
| 2 | 30 |
| 1 | 20 |
| 0 | 10 |

In some embodiments, rather than varying the duty cycle of the dimming control signal 122, it is possible to use a fixed duty cycle and instead vary the frequency of the dimming control signal 122 with the voltage level of the DC output. An example of a linear frequency-based lookup table is shown below in Table 8.

TABLE 8

| Dimmer DC Voltage (V) | Frequency (KHz) |
|---|---|
| 10 | 11 |
| 9 | 10 |
| 8 | 9 |
| 7 | 8 |
| 6 | 7 |
| 5 | 6 |
| 4 | 5 |
| 3 | 4 |
| 2 | 3 |
| 1 | 2 |
| 0 | 1 |

Likewise, a non-linear frequency-based lookup table may also be used for the dimming control signal 122 in some embodiments. An example of a non-linear frequency-based lookup table is shown in Table 9 below with non-linearities at 8-9 V and 1-7 V. The values in all of these Tables 6-9 may be derived using any methodology known to those having ordinary skill in the art, including by experimental trial and error, statistical modeling and simulation, observing and tracking actual usage in the field, and the like.

TABLE 9

| Dimmer DC Voltage (V) | Frequency (KHz) |
|---|---|
| 10 | 11 |
| 9 | 9 |
| 8 | 9 |
| 7 | 8 |
| 6 | 9 |
| 5 | 7 |
| 4 | 7 |
| 3 | 4 |
| 2 | 5 |
| 1 | 2 |
| 0 | 1 |

Figure 18:
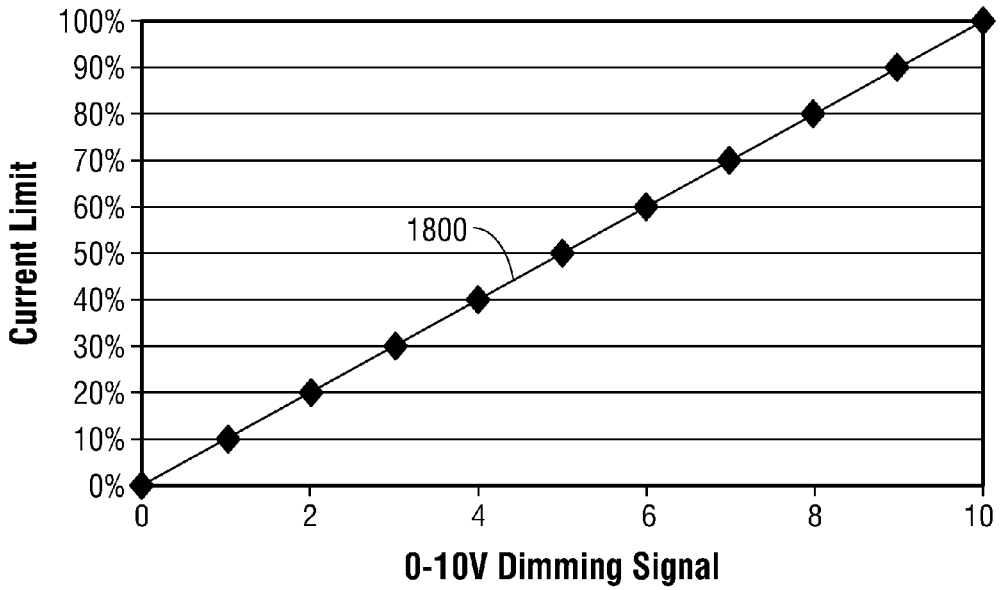
FIG. 18 illustrates an exemplary curve of the relationship between current limit and dimmer voltage for an AC/DC constant voltage converter according to some implementations of the disclosed embodiments.

In some embodiments, in addition to a dimming detection circuit 1620 having a dimming control signal 122, improvements may also be made to the AC/DC constant voltage converter 1618 to address the tendency of the AC/DC constant voltage converter 1618 to draw more current from the dimming controller 1602 in order to offset the decrease in the DC output during dimming. FIG. 18 illustrates an example of the relationship between the current limit and the voltage level of the DC output from the dimming controller 1602 that may be established according to the disclosed embodiments. As line 1800 shows, the current limit of the AC/DC constant voltage converter 1618 and the voltage level of the DC output may have a proportional relationship such that an increase in the voltage level causes an increase in the current limit of the AC/DC constant voltage converter 1618, and vice a versa.

The relationship shown in FIG. 18 may then the used to limit the current in the AC/DC constant voltage converter 1618. As before, an equation may be programmed in the AC/DC constant voltage converter 1618 to limit the amount of current consumed by the AC/DC constant voltage converter 1618 during dimming. Any equation used should of course account for component-specific characteristics of the specific AC/DC constant voltage converter 1618 used so that the resulting current limits provide appropriate protection for the dimming controller 1602 from excessive current consumption.

Figure 19:
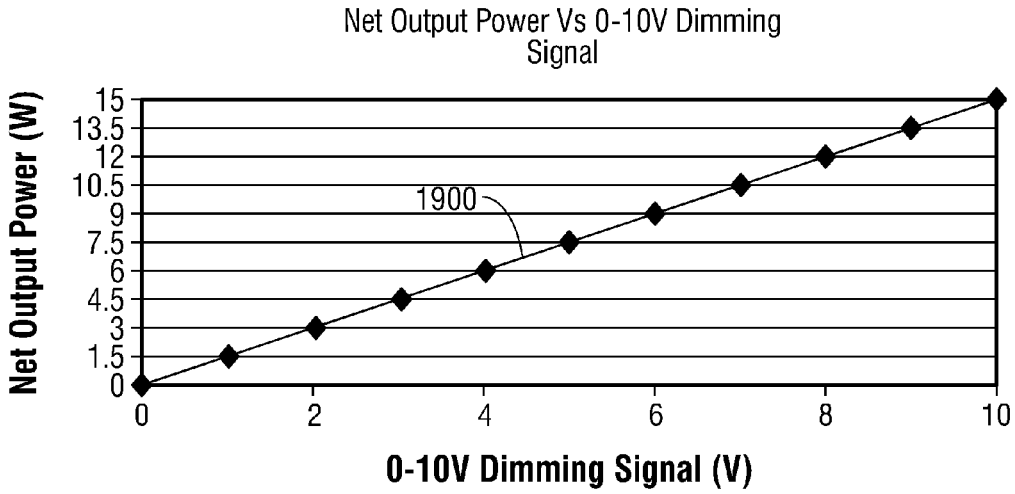
FIG. 19 illustrates an exemplary curve of the relationship between power output and dimmer voltage for an AC/DC constant voltage converter according to some implementations of the disclosed embodiments.

FIG. 19 illustrates the relationship between the current limits of the AC/DC constant voltage converter 1618 and the dimming controller 1602. As illustrated by line 1900 in FIG. 19, the voltage level of the DC output of the dimming controller 1602 and the net output power from the dimming controller 1602, as drawn by the AC/DC constant voltage converter 1618, may have a proportional relationship such that an increase in the voltage level of the DC output causes an increase in the net output power of the dimming controller 1602, and vice versa.

It is also possible to use a lookup table instead of an equation to limit the current in the AC/DC constant voltage converter 1618 in some embodiments. An example of a lookup table that may be programmed in the AC/DC constant voltage converter 1618 is shown in Table 10 below.

TABLE 10

| Dimmer DC Voltage (V) | Output Voltage (V) | Current Limit (mA) | Net Output Power (W) |
|---|---|---|---|
| 10 | 15 | 1000 | 15.0 |
| 9 | 15 | 900 | 13.5 |

TABLE 10-continued

| Dimmer DC Voltage (V) | Output Voltage (V) | Current Limit (mA) | Net Output Power (W) |
|---|---|---|---|
| 8 | 15 | 800 | 12.0 |
| 7 | 15 | 700 | 10.5 |
| 6 | 15 | 600 | 9.0 |
| 5 | 15 | 500 | 7.5 |
| 4 | 15 | 400 | 6.0 |
| 3 | 15 | 300 | 4.5 |
| 2 | 15 | 200 | 3.0 |
| 1 | 15 | 100 | 1.5 |
| 0 | 15 | 0 | 0 |

Figure 20:
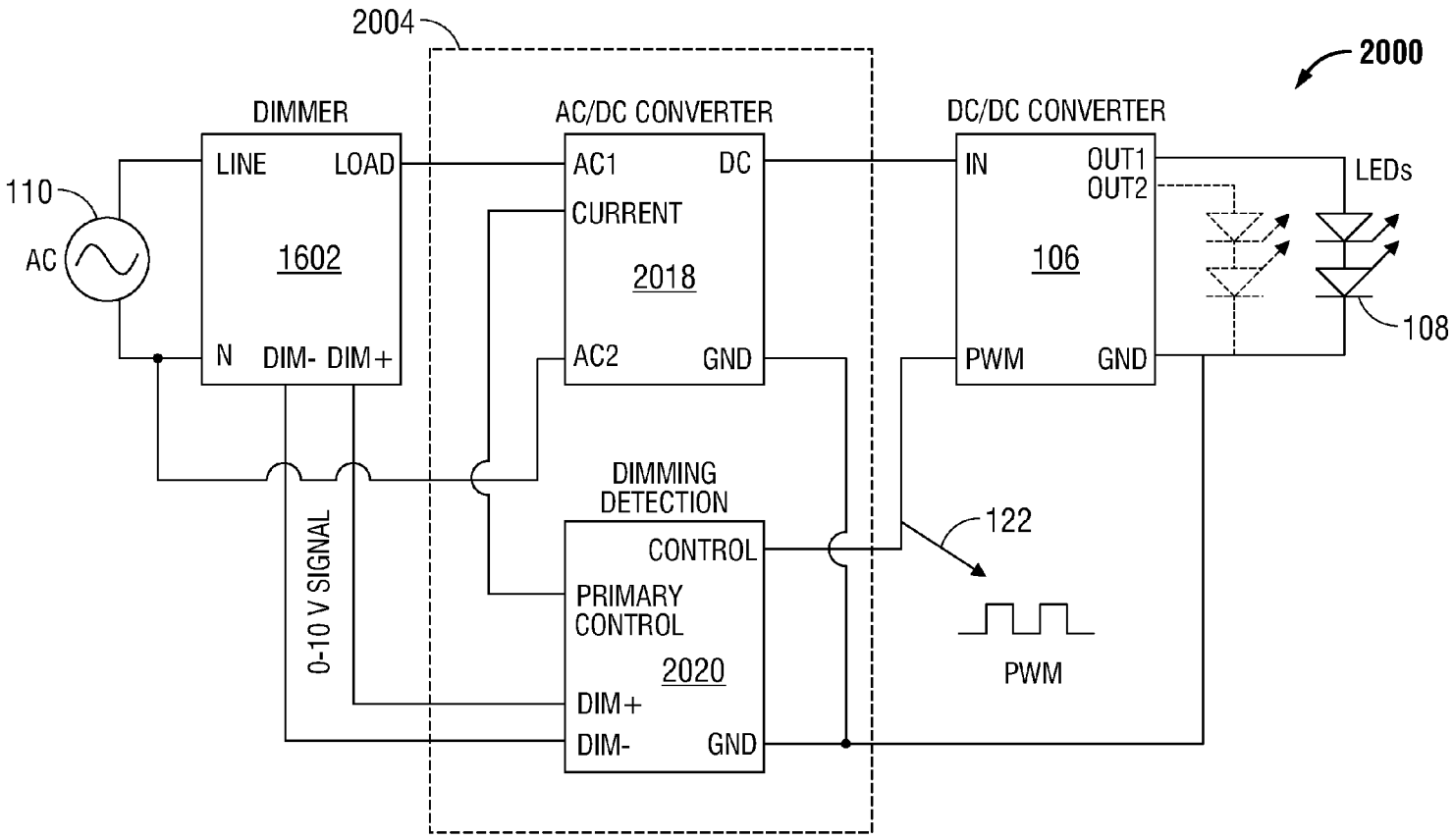
FIG. 20 another exemplary driver circuit for an LED light array having a dimming control signal and a primary side control signal according to some implementations of the disclosed embodiments.

FIG. 20 illustrates yet another LED lighting application 2000 in accordance with the disclosed embodiments. This LED lighting application 2000 has a modified driver circuit 2004, but is similar in all other aspects to the LED lighting application 1600 in FIG. 16. The modified driver circuit 2004 includes a modified AC/DC constant voltage converter 2018 and a modified dimming detection circuit 2020. The modified AC/DC constant voltage converter 2018 operates in much the same way as its counterpart in FIG. 16, except that it has not been programmed to self-limit the amount of current it consumes during dimming. Instead, current consumption by the modified AC/DC constant voltage converter 2018 during dimming may be controlled using a primary side control signal via the primary side control terminal ("Primary Control") of the modified dimming detection circuit 2020. The primary side control signal may then be connected to a primary side current control terminal ("Current") of the modified AC/DC constant voltage converter 2018 to limit the amount of current drawn by the AC/DC constant voltage converter 2018 during dimming. In these embodiments, the primary side control signal may be a PWM signal similar to the dimming control signal 122 discussed above, and may also be derived using the same techniques as the dimming control signal 122 discussed above (i.e., using an equation, a linear lookup table, a non-linear lookup table, etc.).

In addition, although not expressly shown, the LED lighting application 2000 of FIG. 20 and the LED lighting application 1600 of FIG. 16 may each be implemented using optical-couplers or other isolation devices as well as multiple output or control terminals ("Control") on the dimming detection circuit that are connected to the dimming input terminals ("PWM") of multiple downstream DC/DC converters in a manner similar to the embodiments shown in FIGS. 9 and 11-15.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the disclosed embodiments as defined in the appended claims.

What is claimed is:

1. A driver circuit for driving a light source, comprising:

an AC/DC constant voltage converter configured to receive a dimming control output from a dimming controller and provide a constant DC output voltage;

a DC/DC converter connected to the AC/DC constant voltage converter and configured to receive the constant DC output voltage from the AC/DC constant voltage converter, the DC/DC converter further configured to provide a DC output current to the light source; and a dimming detection circuit configured to receive the dimming control output from the dimming controller and provide a dimming control signal to the DC/DC converter, the dimming control signal causing a change in the DC output current provided by the DC/DC converter to the light source when the dimming detection circuit detects a change in the dimming control output, wherein the dimming controller provides the dimming control output to the AC/DC converter and the dimming detection circuit in parallel.

2. The driver circuit of claim 1, wherein the dimming detection circuit is further configured to provide a current control signal to the AC/DC constant voltage converter, the current control signal causing a change in an amount of current consumed by the AC/DC constant voltage converter when the dimming detection circuit detects a change in the dimming control output received by the AC/DC constant voltage converter.

3. The driver circuit of claim 1, wherein the AC/DC constant voltage converter is configured to self-limit an amount of current consumed by the AC DC constant voltage converter based on the dimming control output received by the AC/DC constant voltage converter.

4. The driver circuit of claim 1, wherein the dimming detection circuit is configured to detect one of an RMS voltage value or a DC voltage value of the dimming control output received by the AC/DC constant voltage converter.

5. The driver circuit of claim 4, wherein the dimming control signal provided by the dimming detection circuit is a PWM signal that is proportional to the RMS voltage value or the DC voltage value detected by the dimming detection circuit.

6. The driver circuit of claim 5, wherein the dimming control signal has a duty cycle that is set using one of: a linear lookup table, a non-linear lookup table, and a predefined equation.

7. The driver circuit of claim 1, wherein the dimming control signal has a frequency that is set using one of: a linear lookup table, a non-linear lookup table, and a predefined equation.

8. A method of driving an LED light source using an AC/DC constant voltage converter and a DC/DC converter, comprising:

detecting a dimming control output at the AC/DC constant voltage converter from a dimming controller;

providing a dimming control signal to the DC/DC converter in response to detecting the dimming control output at the AC/DC constant voltage converter;

detecting a change in the dimming control output at the AC/DC constant voltage converter;

changing the dimming control signal provided to the DC/DC converter in proportion to the change detected in the dimming control output at the AC/DC constant voltage converter such that the dimming control signal causes a change in a DC output current provided by the DC/DC converter when a change is detected in the dimming control output at the AC/DC constant voltage converter; and coupling the dimming detection circuit to the DC/DC converter using an isolation device.

9. The method of claim 8, further comprising providing a current control signal to the AC/DC converter such that the current control signal causes a change in an amount of current consumed by the AC/DC converter when a change is detected in the AC output at the AC/DC constant voltage converter.

10. The method of claim 8, further comprising the AC/DC constant voltage converter self-limiting an amount of current consumed by the AC/DC constant voltage converter based on the dimming control output detected at the AC/DC constant voltage converter.

11. The method of claim 8, wherein detecting the dimming control output at the AC/DC constant voltage converter comprises detecting one of an RMS voltage value or a DC voltage value from the dimming control output at the AC/DC constant voltage converter.

12. The method of claim 11, wherein the dimming control signal is a PWM signal that is proportional to the RMS voltage value or the DC voltage value detected from the dimming control output at the AC/DC constant voltage converter.

13. The method of claim 12, wherein the dimming control signal has a duty cycle, further comprising setting the duty cycle of the dimming control signal using one of: a linear lookup table, a non-linear lookup table, and a predefined equation.

14. The method of claim 8, wherein the dimming control signal has a frequency, further comprising setting the frequency using one of: a linear lookup table, a non-linear lookup table, and a predefined equation.

15. A driver circuit for driving LED light sources, comprising:

an AC/DC constant voltage converter configured to receive an dimming control output from a dimming controller and provide a constant DC output voltage;

a plurality of DC/DC converters connected to the AC/DC constant voltage converter, each DC/DC converter configured to receive the constant DC output voltage from the AC/DC constant voltage converter and provide a DC output current to one or more of the LED light sources; and a dimming detection circuit connected to the AC/DC constant voltage converter, the dimming detection circuit configured to detect the dimming control output received by the AC/DC constant voltage converter and provide a dimming control signal to the DC/DC converter, the dimming control signal causing a change in the DC output current provided by the DC/DC converter to the one or more of the LED light sources when the dimming detection circuit detects a change in the dimming control output received by the AC/DC constant voltage converter;

wherein the dimming detection circuit is further configured to provide a current control signal to the AC/DC constant voltage converter, the current control signal causing a change in an amount of current consumed by the AC/DC constant voltage converter when the dimming detection circuit detects a change in the dimming control output received by the AC/DC constant voltage converter.

16. The driver circuit of claim 15, wherein the reduction in the dimming control output received by the AC/DC constant voltage converter is implemented by phase cutting the AC output received by the AC/DC constant voltage converter.

17. The driver circuit of claim 15, wherein the dimming detection circuit is configured to detect one of an RMS voltage value or a DC voltage value from the dimming control output received by the AC/DC constant voltage converter.

18. The driver circuit of claim 17, wherein the dimming control signal provided by the dimming detection circuit is a PWM signal that is proportional to the RMS voltage value or at the DC voltage value detected by the dimming detection circuit.

19. The driver circuit of claim 18, wherein the dimming control signal has a duty cycle that is set using one of: a linear lookup table, a non-linear lookup table, and a predefined equation.

20. The driver circuit of claim 18, wherein the dimming control signal has a frequency that is set using one of: a linear lookup table, a non-linear lookup table, and a predefined equation.

21. A driver circuit for driving a light source, comprising:

an AC/DC constant voltage converter configured to receive a dimming control output from a dimming controller and provide a constant DC output voltage;

a DC/DC converter connected to the AC/DC constant voltage converter and configured to receive the constant DC output voltage from the AC/DC constant voltage converter, the DC/DC converter further configured to provide a DC output current to the light source; and;

a dimming detection circuit connected to the AC/DC constant voltage converter, the dimming detection circuit configured to directly detect the dimming control output received by the AC/DC constant voltage converter and provide a dimming control signal to the DC/DC converter, the dimming control signal causing a change in the DC output current provided by the DC/DC converter to the light source when the dimming detection circuit detects a change in the dimming control output received by the AC/DC constant voltage converter.

22. The driver circuit of claim 21, wherein the dimming detection circuit is further configured to provide a current control signal to the AC/DC constant voltage converter, the current control signal causing a change in an amount of current consumed by the AC/DC constant voltage converter when the dimming detection circuit detects a change in the dimming control output received by the AC/DC constant voltage converter.

23. The driver circuit of claim 21, wherein the AC/DC constant voltage converter is configured to self-limit an amount of current consumed by the AC DC constant voltage converter based on the dimming control output received by the AC/DC constant voltage converter.

* * * * *